US005627434A

United States Patent [19]

Sekiya et al.

[11] Patent Number: 5,627,434

[45] Date of Patent: May 6, 1997

[54] APPARATUS FOR OPERATING A FLUORESCENT LAMP OF AN IMAGE FORMING APPARATUS

[75] Inventors: Toshiyuki Sekiya, Yokohama; Tadashi Ishikawa, Tokyo; Atsushi Asayama, Yokohama, all of Japan

[73] Assignee: Canon Kabushiki Kaisha, Tokyo, Japan

[21] Appl. No.: 326,238

[22] Filed: Oct. 20, 1994

[30] Foreign Application Priority Data

Oct. 26, 1993 [JP] Japan ..... 5-267236
Jan. 31, 1994 [JP] Japan ..... 6-009466

[51] Int. Cl.[6] ..... H05B 39/00

[52] U.S. Cl. ..... 315/94; 315/98; 315/219; 315/222; 315/291; 315/DIG. 5

[58] Field of Search ..... 355/229, 67, 69; 315/94, 96, 98, 100, 101, 105, 106, 107, DIG. 4, DIG. 5, 291, 239, 276

[56] References Cited

U.S. PATENT DOCUMENTS 4,378,515 3/1983 Nakai et al. ..... 315/290
4,920,299 4/1990 Presz et al. ..... 315/98
4,980,811 12/1990 Suzuji et al. ..... 363/21
4,988,920 1/1991 Hoeksma ..... 315/101

FOREIGN PATENT DOCUMENTS 0422594 4/1991 European Pat. Off. .
0429716 6/1991 European Pat. Off. .
3048531 9/1981 Germany .
3903520 8/1989 Germany .
2212995 8/1989 United Kingdom .

*Primary Examiner*—Robert Pascal
*Assistant Examiner*—Haissa Philogene
*Attorney, Agent, or Firm*—Fitzpatrick, Cella, Harper & Scinto

[57] ABSTRACT

An apparatus for operating a fluorescent lamp having first and second power source circuits, the second power source circuit including a high frequency transformer having two or more outputs for supplying pre-heating electric currents to filaments, the second power source circuit being arranged to be controllable individually from the first power source circuit for supplying a tube electric current to turn on a fluorescent lamp so that the electric power level for pre-heating the filaments is switched between a state where a light adjustment is performed by turning on/off a tube electric current at high frequency and a state where the fluorescent lamp is turned off in a standby mode.

32 Claims, 17 Drawing Sheets

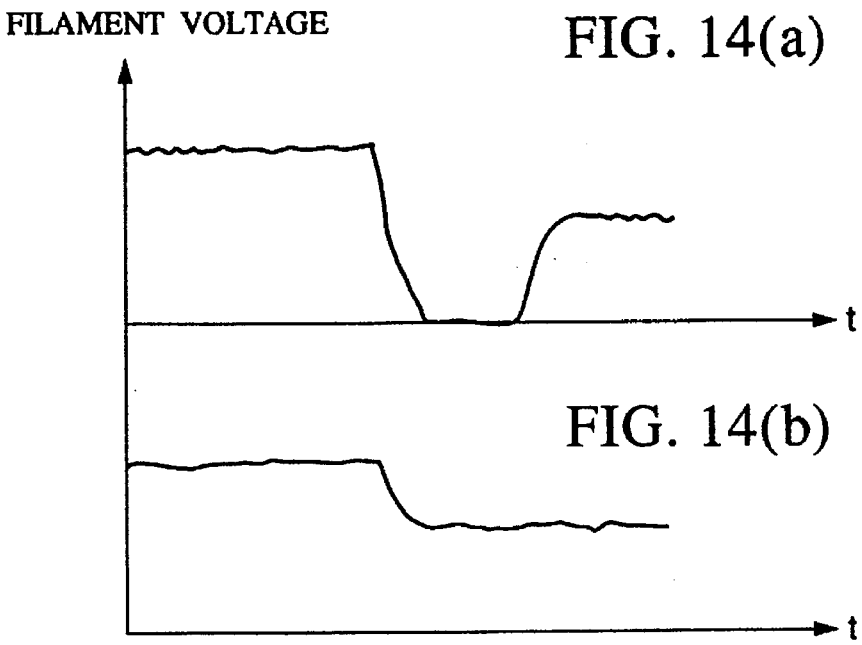
FIG. 15
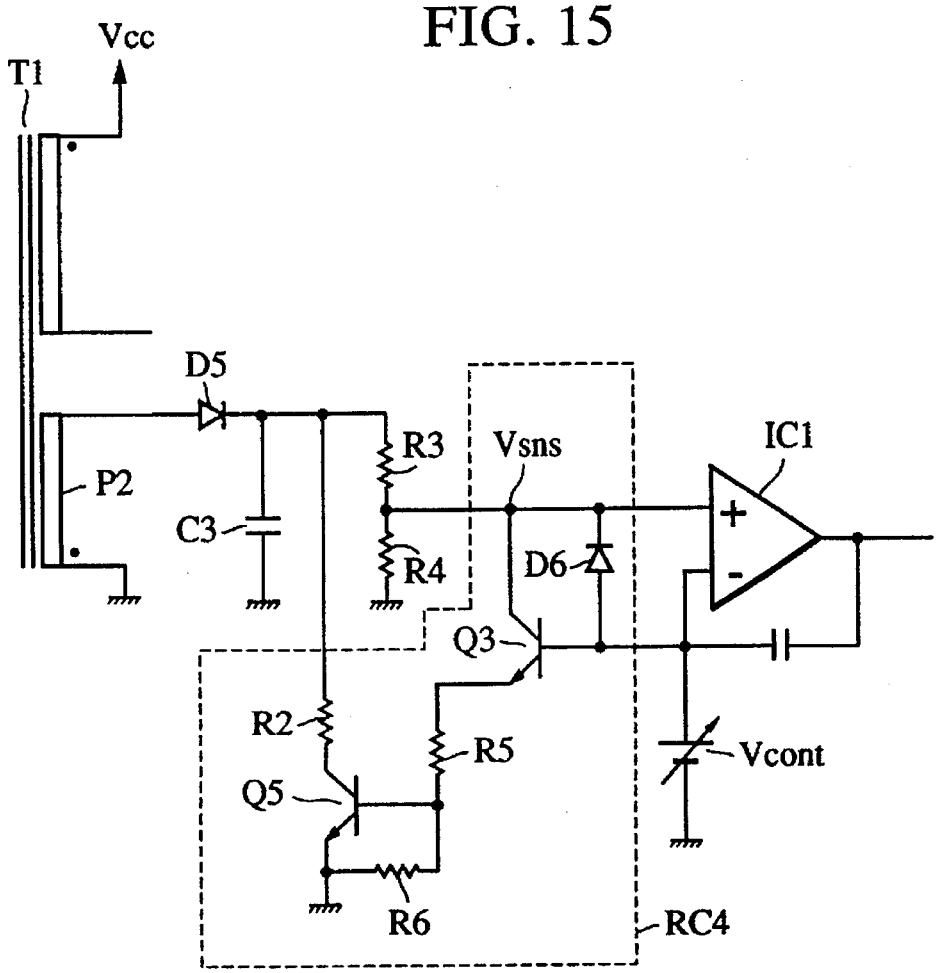

CONVENTIONAL APPARATUS

CONVENTIONAL OPERATION

APPARATUS FOR OPERATING A FLUORESCENT LAMP OF AN IMAGE FORMING APPARATUS

BACKGROUND OF THE INVENTION

1. Field of the Invention

The present invention relates to an apparatus for operating a fluorescent lamp which is used as a light source in a copying machine or facsimile apparatus and which exposes an original document to light.

2. Description of Related Art

Hitherto, a light source for exposing an original document to light in a copying machine, such as an electrophotographic apparatus, has mainly been a halogen lamp or a fluorescent lamp. A fluorescent lamp is usually employed in a low-speed machine that does not require a large amount of light. Since the fluorescent lamp consumes a very small amount of electric power, employment of a fluorescent lamp in higher speed machines is preferable.

An example of a drive circuit and of a control circuit for a fluorescent lamp to be mounted on a copying machine are shown in FIG. 17.

Reference numeral 1 represents a fluorescent lamp, 2 represents an inductor for limiting an electric current for turning on the fluorescent lamp 1, 3 represents an inverter transformer, 4 represents an inverter transformer drive transistor, 5 represents a resonance capacitor, 6 represents a DC stabilizing power source in the apparatus, 7 represents a diode bridge, 8 represents a control transistor for turning the fluorescent lamp 1 on and off, 9 and 10 represent bypass capacitors, 11 and 12 represent filaments in the fluorescent lamp 1, and 13 represents an oscillator. Reference numeral 20 represents a commercial AC power source, 21 represents an AC-to-DC converter for generating a low-level DC output voltage VDD for use in the apparatus from the commercial AC power source 20, 22 represents a system controller for controlling the system of the apparatus, and 23 represents a mode signal for controlling the output voltage VDD from the AC-to-DC converter 21.

The operation of the circuit shown in FIG. 17 will now be described with reference to a timing chart shown in FIG. 18. When electric power is supplied to the apparatus, the apparatus is brought into a standby mode. At this time, a standby mode signal is supplied from the controller 22 to the AC-to-DC converter 21. This results in an output voltage VDD from the AC-to-DC converter 21 that is lower than the voltage level required in the copying operation, the lower voltage level being 12 V in this embodiment.

The fluorescent lamp 1 is turned off during the standby mode. However, a low level pre-heating electric current must be supplied to the filaments 11 and 12 in order to smoothly turn on the fluorescent lamp 1 when the copying operation starts. In this case, the output voltage from the AC-to-DC converter 21 is applied to an end of the input of the inverter transformer 3. Another end of the input is switched on and off at a frequency of 30 KHz in accordance with an output from the oscillator 13 input to the base of inverter transformer drive transistor 4. Thus, a high level voltage Vh resulting from the winding ratio is outputted from the inverter transformer 3. Since the Light On signal is off, the diode bridge 7 is short-circuited by the control transistor 8 at this time, and the output from the inverter transformer 3 forms a series circuit with the inductor 2, the filament 11 in parallel with the bypass capacitor 9, and the filament 12 in parallel with the bypass capacitor 10.

Therefore, in the case where the impedance of the filament is quite low, the output coil electric current is approximately as follows:

$$Vh/j\omega L.$$

A value obtained by subtracting an electric current flowing through the bypass capacitors 9 and 10 from the foregoing value is the pre-heating electric current which flows through the filaments 11 and 12 of the fluorescent lamp 1. In this embodiment, a filament electric current of 350 mA flows at this time; this state is called a half pre-heating state.

When a copying key is then depressed, a copy mode signal is supplied from the controller 22 to the AC-to-DC converter 21. As a result, the output voltage $V_{DD}$ from the AC-to-DC converter 21 is raised to a level with which each unit in the apparatus can be operated, the raised level being 24 V in this embodiment. Thus, the output coil voltage from the inverter transformer 3 is substantially doubled, and therefore the pre-heating electric current is substantially doubled. In this embodiment, a filament electric current of 700 mA flows at this time and the foregoing state is called a full pre-heating state. The full pre-heating state that exists immediately before the fluorescent lamp is turned on is effective to quickly turn on the fluorescent lamp 1. Usually, the foregoing process is a required sequence.

The short-circuit state of the diode bridge 7 is suspended when the original document is exposed to light by turning on the Light On signal which turns on the control transistor 8. This causes the output voltage from the inverter transformer 3 to be applied to both ends of the fluorescent lamp 1. As a result, the fluorescent lamp 1 is turned on. When the exposure time expires, the diode bridge 7 is again short-circuited, causing the fluorescent lamp 1 to be turned off. The full pre-heating mode continues until the apparatus completes the post-exposure processing of the copying operation and the apparatus then returns to the standby mode.

A high-speed machine is able to employ a fluorescent lamp as the exposing light source only if the fluorescent lamp is capable of emitting a large amount of light and has a long operating life. For the fluorescent lamp to emit a large amount of light, to have stable light adjustment capability for preventing flickers, to lengthen the life of the filaments thereof, and to prevent blacking of the tube surface near the filaments, the temperature of each filament at the time of the light adjustment must be controlled precisely.

However, the conventional method cannot, in the operation sequence of the apparatus, precisely control the pre-heating electric power for use in the light adjustment process. Use of the conventional method also causes exhaustion of electron emission substances in the filaments, disconnection of the filaments and reduction in the light quantity due to excess blacking of the tube surface, thereby shortening the operating life of the filament.

SUMMARY OF THE INVENTION

Accordingly, an object of the present invention is to provide an apparatus for operating a fluorescent lamp for use as a light source in a copying machine or a facsimile machine for exposing an original document to light, the apparatus being capable of quickly turning the fluorescent lamp on and lengthening the life of the same.

Another object of the present invention is to provide an apparatus for operating a fluorescent lamp having an arrangement wherein the fluorescent lamp is pre-heated in accordance with the state of operation of the fluorescent lamp so as to quickly turn the fluorescent lamp on and lengthen the life of the same.

Another object of the present invention is to provide an apparatus for operating a fluorescent lamp capable of turning on a fluorescent lamp in a copying machine or a facsimile machine for exposing an original document to light.

According to one aspect of the present invention, there is provided an apparatus for operating a fluorescent lamp having a first power source unit for supplying a tube electric current to a fluorescent lamp to turn on the fluorescent lamp; a second power source unit for supplying pre-heating electric currents to filaments of the fluorescent lamp; and a switching unit for switching the electric power level of the pre-heating electric currents to be supplied to the filaments by the second power source means.

According to another aspect of the present invention, there is provided an apparatus for operating a fluorescent lamp having a first power source unit for supplying a tube electric current to a fluorescent lamp to turn on the fluorescent lamp; a second power source unit for supplying pre-heating electric currents to filaments of the fluorescent lamp; and a control unit that monitors an output from the second power source means to control the electric power level of the pre-heating electric currents to be supplied from the second power source means to the filaments.

Other and further objects, features and advantages of the invention will be evident from the following detailed description of the preferred embodiments in conjunction with the attached drawings.

BRIEF DESCRIPTION OF THE DRAWINGS

FIG. 14 (*a*) is a graph showing the filament voltage waveform of the seventh embodiment of the present invention; FIG. 14 (*b*) is a graph showing the filament voltage waveform of the conventional apparatus;

FIG. 15 is a circuit diagram which illustrates a portion of the seventh embodiment of the present invention;

DETAILED DESCRIPTION OF THE PREFERRED EMBODIMENTS

Figure 1:
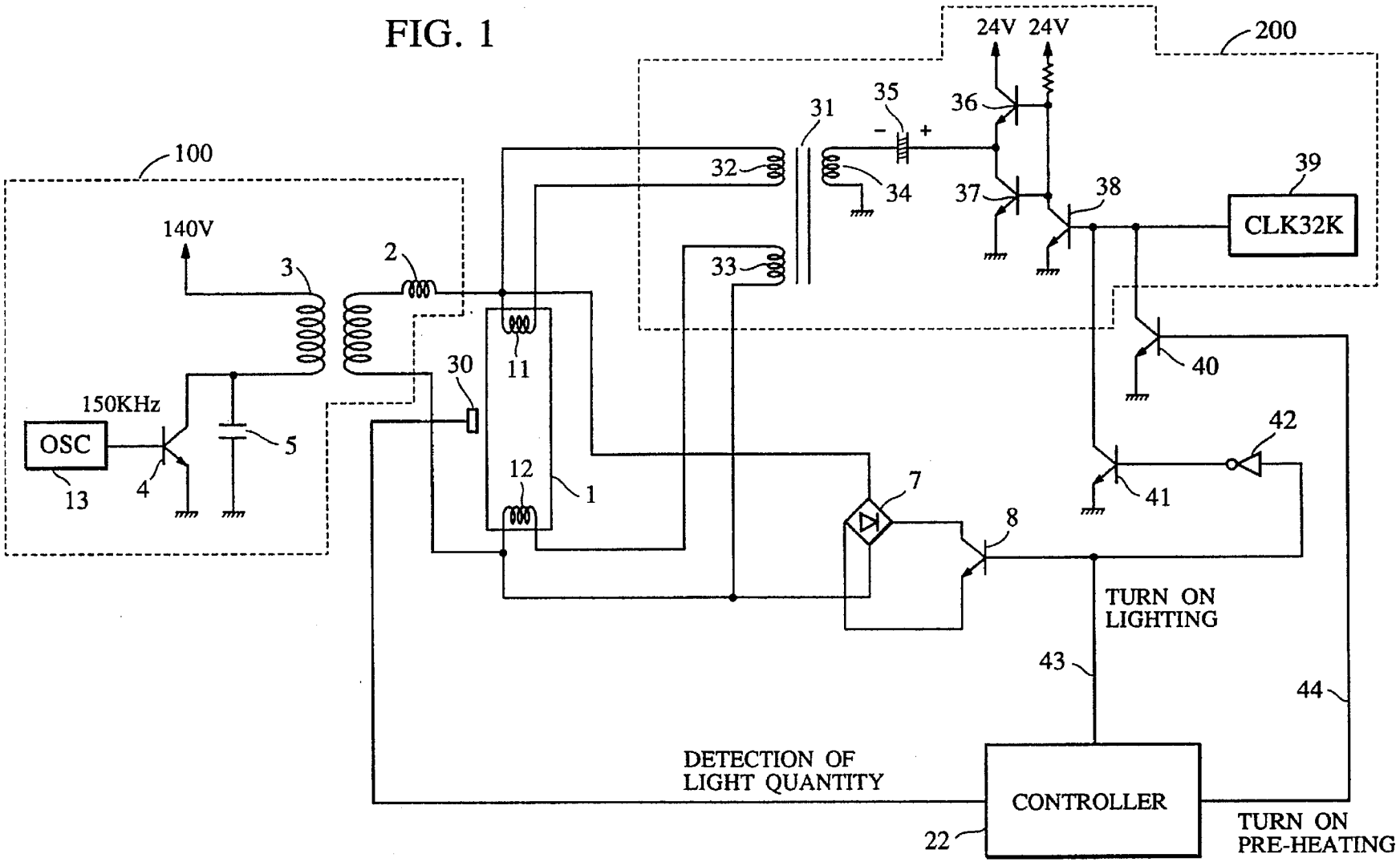
FIG. 1 is a block diagram which illustrates a first embodiment of the present invention.

The present invention will now be described in detail while taking preferred embodiments for example.

First Embodiment

Referring to a block diagram shown in FIG. 1 and timing charts shown in FIG. 2, a first embodiment of the present invention will now be described. The same elements as those of the foregoing structure are given the same reference numerals and their descriptions are omitted here.

Reference numeral 100 represents a first drive circuit for generating an electric current to be supplied to a glow starter of the fluorescent lamp 1. In this embodiment, the first drive circuit 100 is not involved in pre-heating the filaments.

A second drive circuit 200 is a circuit used only for pre-heating the filaments such that precise and sufficient pre-heating electric power is supplied to each of the filaments from the first drive circuit 100.

Reference numeral 31 represents a high-frequency transformer for supplying pre-heating electric currents to the filaments 11 and 12. The high-frequency transformer 31 according to this embodiment comprises two output-coils 32 and 33 connected to the filaments 11 and 12, respectively, of the fluorescent lamp 1, and an input coil 34 for supplying electric power. Reference numeral 35 represents a coupling capacitor for AC-coupling outputs of transistors 36 and 37 and the transformer 31. Reference numeral 38 represents a switching transistor that receives a signal from an oscillator 39 serving as an oscillation source for driving the fluorescent lamp 1 to supply a high or low level signal to the output ports 36 and 37.

The operation of the second drive circuit 200 is interrupted when the level of a pre-heating turning-on signal 44, supplied through connection by the controller 22, is high, and therefore a switching device 40 is short circuited. Similarly, the operation of the second drive circuit 200 is interrupted by an inverter 42 and a switching device 41 when the level of a turning-on signal 43, supplied through connection, is low. As a result, pre-heating is completely inhibited during a period in which the fluorescent lamp 1 is turned on. In this embodiment, an assumption is made that the filament temperature is raised sufficiently during a period in which the fluorescent lamp 1 is turned on and no external pre-heating is required. If the characteristics of the fluorescent lamp 1 cause the filaments 11 and 12 to be sufficiently pre-heated, the switch 41 may be omitted from the structure.

Figure 3:
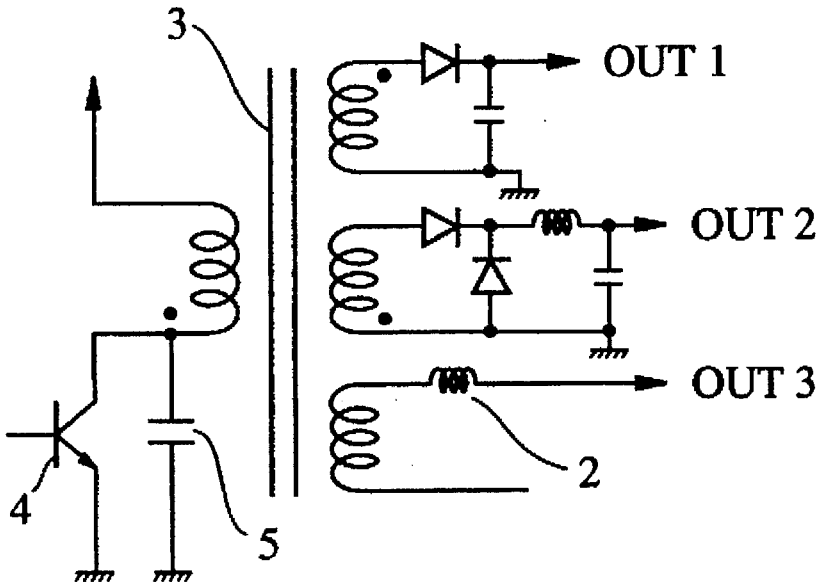
FIG. 3 is a circuit diagram which illustrates a drive circuit according to the first embodiment of the present invention.

In the foregoing arrangement, the function of the drive circuit for supplying the electric current to the fluorescent lamp and the function of the circuit for pre-heating the filaments are completely separated from each other. This is one of the characteristics of this embodiment, the arrangement providing the following effects:

(1) In a case where the first drive circuit 100 provides, for example, output OUT3, which is one of outputs of a multi-output-type transformer as shown in FIG. 3, when the loads of other outputs are considerably changed, the output from the coil for the fluorescent lamp is excessively affected, and the stability becomes unsatisfactory, but a quite stable and accurate pre-heating electric current can be supplied from the second drive circuit completely independent of load change.

(2) In a case where the maximum filament pre-heating electric current required is larger than the maximum tube electric current for the fluorescent lamp generated by the first drive circuit 100, the electric current for pre-heating the filaments can be partially or fully supplied from the second drive circuit that can be controlled independently from the first drive circuit.

The operation and the characteristics of the sequence will now be described with reference to a timing chart shown in FIG. 2 in such a manner that the process is classified into the following states:

(1) A state where the apparatus is in a standby mode in which the fluorescent lamp is turned off and the filaments half-way pre-heated.

(2) A state before the fluorescent lamp is turned on and the filaments are fully pre-heated.

(3) A light adjustment state in which the fluorescent lamp is switched on or off at high frequency.

(1) Since the apparatus is in the standby mode, the level of the turning-on signal is raised and the diode bridge 7 is short-circuited. Therefore, no voltage is applied to the two ends of the fluorescent lamp 1 from the first drive circuit 100 and thus no tube electric current flows. On the other hand, the pre-heating turning-on signal consists of a 50%-duty, 5 KHz signal which turns on/off the switching device 40. The switching device 40 gates 32 KHz original clocks serving as pre-heating drive signals which are output from the oscillator 39 at each 200 μs for a period of about 100 μs. Thus, an effective voltage, which is substantially the half of the voltage which is applied at the time of the full pre-heating mode, is applied to the filaments 11 and 12. In this embodiment, the transformer is designed such that a root mean square voltage of 5 Vrms is applied to each of the filaments 11 and 12 during the full pre-heating mode, and thus electric power of 2.5 Vrms is, at the half pre-heating, supplied due to the control of the effective voltage by pulse width modulation (hereinafter PWM).

The half pre-heating operation is required to prevent flowing of high transient currents to the filaments 11 and 12 due to the low temperature and to raise the temperature of the filaments to a predetermined turning on level in a shorter full pre-heating time.

(2) In order to quickly bring the fluorescent lamp 1 to a stable "ON" state, lengthen the life of each of the filaments 11 and 12, and prevent blacking of the tube surface, the filaments 11 and 12 must be heated to a predetermined temperature level immediately before the fluorescent lamp 1 is turned on. The foregoing process is a full pre-heating process in which the level of the pre-heating turning-on signal 44 supplied through connection is lowered for 1.5 seconds in this embodiment, causing a 32 KHz original clock to be supplied from the oscillator 39 to the full output port so that a root mean square voltage of 5 Vrms is applied to each of the filaments 11 and 12.

(3) The level of the turning-on signal is lowered and the short circuit state of the diode bridge 7 is suspended so that the output from the first drive circuit 100 is supplied to the two ends of the fluorescent lamp 1. If the full pre-heating to be performed in (2) has been satisfactorily performed, the fluorescent lamp 1 is usually immediately (that is, within a period of 1 to 2 pulses transmitted from the first drive circuit) turned on. In accordance with the output from the light adjustment sensor 30, the level of the turning-on signal 43 is switched between the high level and the low level at a frequency of 1 KHz so that a predetermined light quantity is obtained.

The pre-heating electric power to be supplied when the fluorescent lamp 1 is turned off (in a region in which the level of the turning-on signal is high) during the light adjustment process considerably affects the life of the fluorescent lamp 1. If no pre-heating is performed, the temperature of the filaments 11 and 12 is lowered in a case where the turning on ratio (the ratio of turning on to turning off in the light adjustment process) is low. The fluorescent lamp 1 and the filaments 11 and 12 must bear heavy loads whenever the fluorescent lamp 1 is turned on during the light adjustment process. If pre-heating is performed excessively, the filaments 11 and 12 are heated excessively and thus are similarly adversely affected.

Accordingly, the following characteristic control processes are performed:

(A) The operation of the second drive circuit 200 is stopped when the fluorescent lamp 1 is turned off during the light adjustment process.

(B) When the fluorescent lamp 1 is turned off during the light adjustment process, supply/non-supply of the drive signal (a 32 KHz signal in this embodiment) to the second drive circuit 200 is PWM-controlled by using the pre-heating turning-on signal 41 at a frequency which is two times to five times the turn on lighting signal frequency (which is 1 KHz in this embodiment) for use in the light adjustment process so as to control the filament temperature to an adequate level.

By changing the duty cycle in the PWM in (B) in accordance with the turning on ratio, a more ideal level of the filament temperature can be achieved. However, the PWM duty-cycle can, of course, be fixed regardless of the turning on ratio depending upon the characteristics and the desired life of the fluorescent lamp. In any case, one or more 32 KHz pre-heating AC signals can be supplied whenever the fluorescent lamp 1 is turned off if the turning on ratio is about 75%. Therefore, the temperature can be precisely controlled without the filament temperature ripple being lower than the light adjustment frequency.

Second Embodiment

A second embodiment of the present invention will now be described in detail with reference to the drawings.

Although the first embodiment has the characteristics that no temperature ripple lower than the light adjustment frequency is generated because the supply/non-supply of the drive signal to the second drive circuit 200 is controlled at frequency which is two times to five times the light adjustment frequency when the fluorescent lamp 1 is turned off during the light adjustment using the first drive circuit 100, a PWM signal, the frequency of which is two to five times the light adjustment frequency, is required. Therefore, an exclusive PWM circuit or a port output from the controller (a microcomputer) with software must be used to transmit the PWM signal. If the exclusive PWM circuit is used additionally, the circuit structure becomes too complicated and therefore the cost cannot be reduced. If the software is used to transmit the PWM signal, the PWM signal cannot easily be transmitted with such a high frequency because of a limitation involved by the other system processing time.

Figure 4:
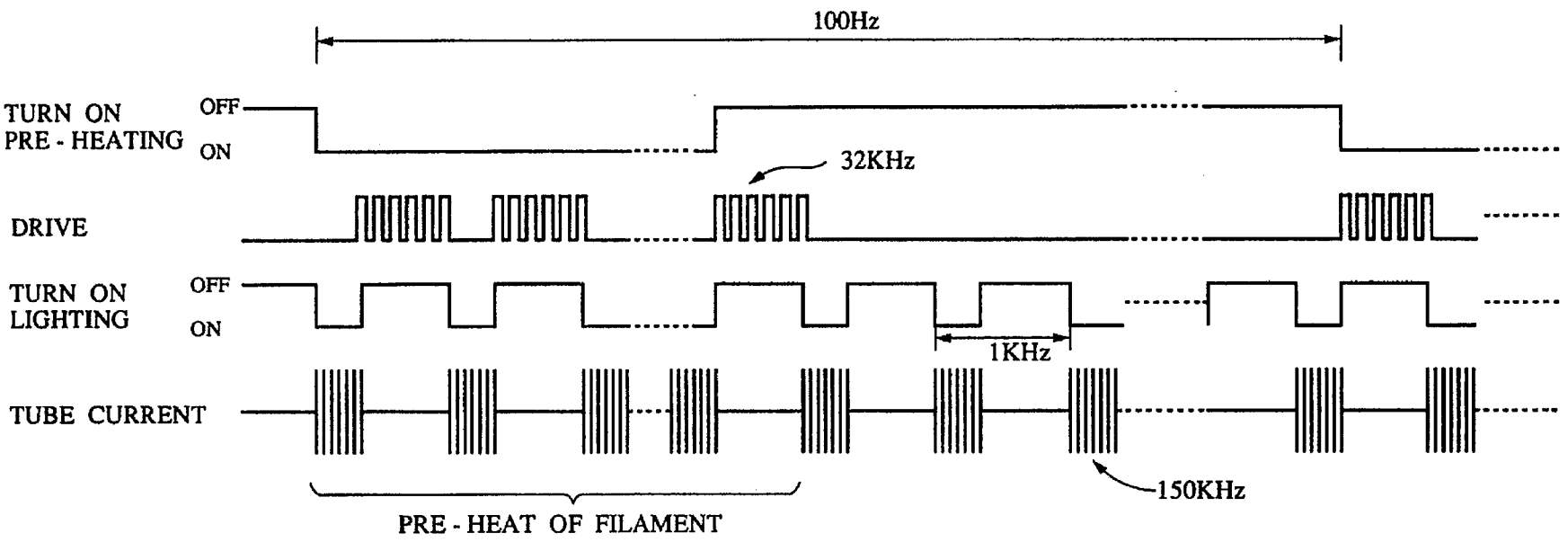
FIG. 4 is a timing chart which illustrates the second embodiment of the present invention.

Accordingly, this embodiment has an arrangement that a PWM signal, the frequency of which is ½ to ⅕ or lower (100 Hz in this embodiment) than the light adjustment frequency (1 KHz in this embodiment), is transmitted as the pre-heating turning-on signal 44. A timing chart about the foregoing operation is shown in FIG. 4. Since the pre-heating turning-on signal 44 having a frequency of 100 Hz is transmitted during the light adjustment process in this embodiment, the 32 KHz drive signal is, during a period in which the level of the pre-heating turning-on signal 44 is low, transmitted to the second drive circuit 200 when the fluorescent lamp 1 is turned off. When the pre-heating turning-on signal level is high, the operation of pre-heating the filaments 11 and 12 is stopped in both cases where the fluorescent lamp 1 is turned on and the same is turned off. As a result, temperature ripples of 100 Hz occur during the light adjustment process. However, this embodiment is effective as a simple and convenient method if the actual temperature ripple quantity does not practically affect the life of the fluorescent lamp.

Third Embodiment

Referring to a block diagram shown in FIG. 5 and a timing chart shown in FIG. 6, a third embodiment will now be described.

Figure 2:
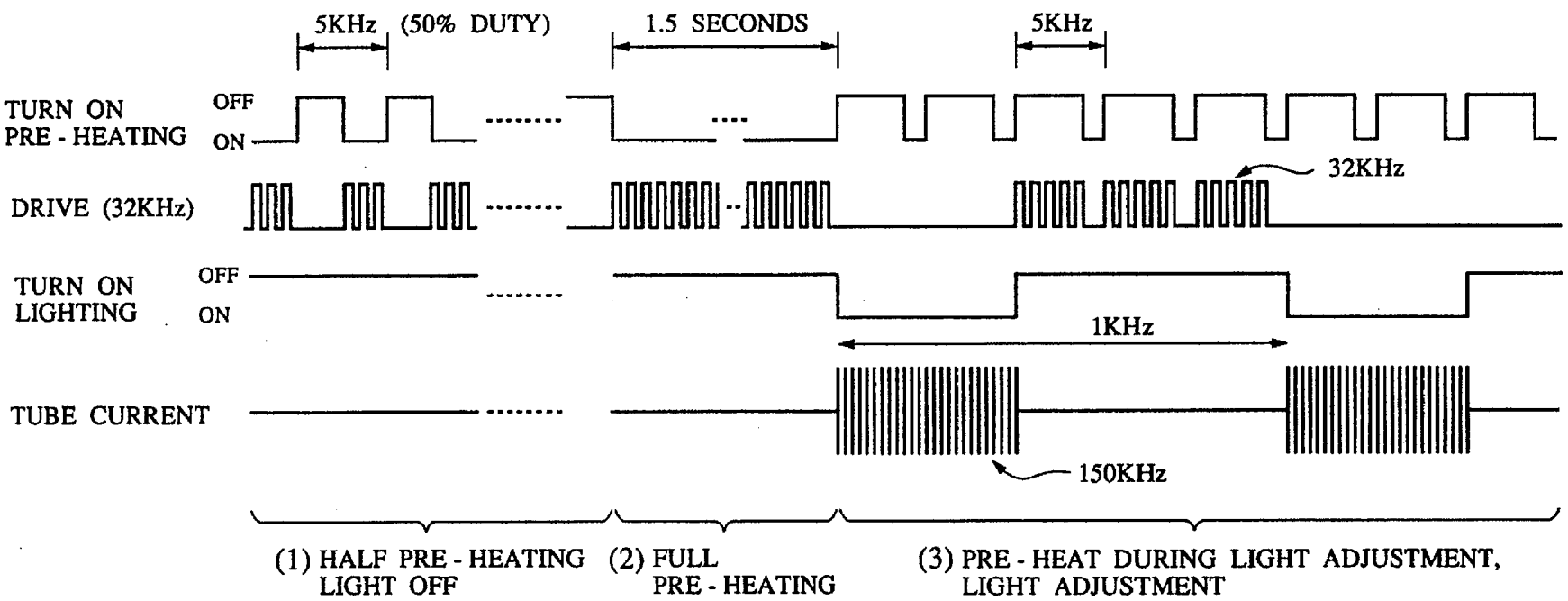
FIG. 2 is a timing chart which illustrates the first embodiment of the present invention.

The same elements as those shown in FIG. 1 are given the same reference numerals.

This embodiment is characterized by a pre-heating voltage amplitude adjustment circuit 50. The circuit 50 receives a pre-heating level switching signal 45 supplied from the controller 22 to switch the drive amplitude for the primary side of the pre-heating power supplying transformer 31 by the following procedure in accordance with the level of the pre-heating level switching signal 45 so as to switch the amplitude of the AC voltage to be applied to the filaments 11 and 12.

When the full pre-heating is performed before the fluorescent lamp 1 is turned on, the level of the pre-heating level switching signal 45 is high. A rated-voltage controller 58 detects the voltage of a capacitor 54 connected to the power supply line of the output portion of a pre-heating transformer drive circuit by using a detecting resistor 55. The transistor 57 is turned on at the foregoing time and a divided voltage ratio switching resistor 56 for the detecting resistor 55 is connected to the ground level so that the divided voltage ratio is lowered. In accordance with the detected voltage, the rated-voltage controller 58 turns off the transistor 51 if the detected voltage is higher than a reference value (not shown) stored in the rated-voltage controller 58 while the same turns on the transistor 51 if the detected voltage is lower than the reference value. Thus, an inductor 53 and a flywheel diode 52 force the capacitor 54 to a previously rated voltage level. The foregoing voltage serves as the power source for the pre-heating transformer drive circuit so that the output amplitude for the full pre-heating process is determined.

When the light adjustment process is performed, the level of the pre-heating level switching signal 45 is low and thus the transistor 57 is turned off. As a result, the resistor 56 is disconnected and the divided voltage ratio possessed by the detecting resistor 55 is restored (the voltage is raised). Thus, the voltage of the capacitor 54 is lowered by a predetermined degree as compared with the voltage to be applied in the full pre-heating process. The lowered voltage serves as the power source for the pre-heating transformer drive circuit so that the output amplitude for the light adjustment process is determined.

Figure 6:
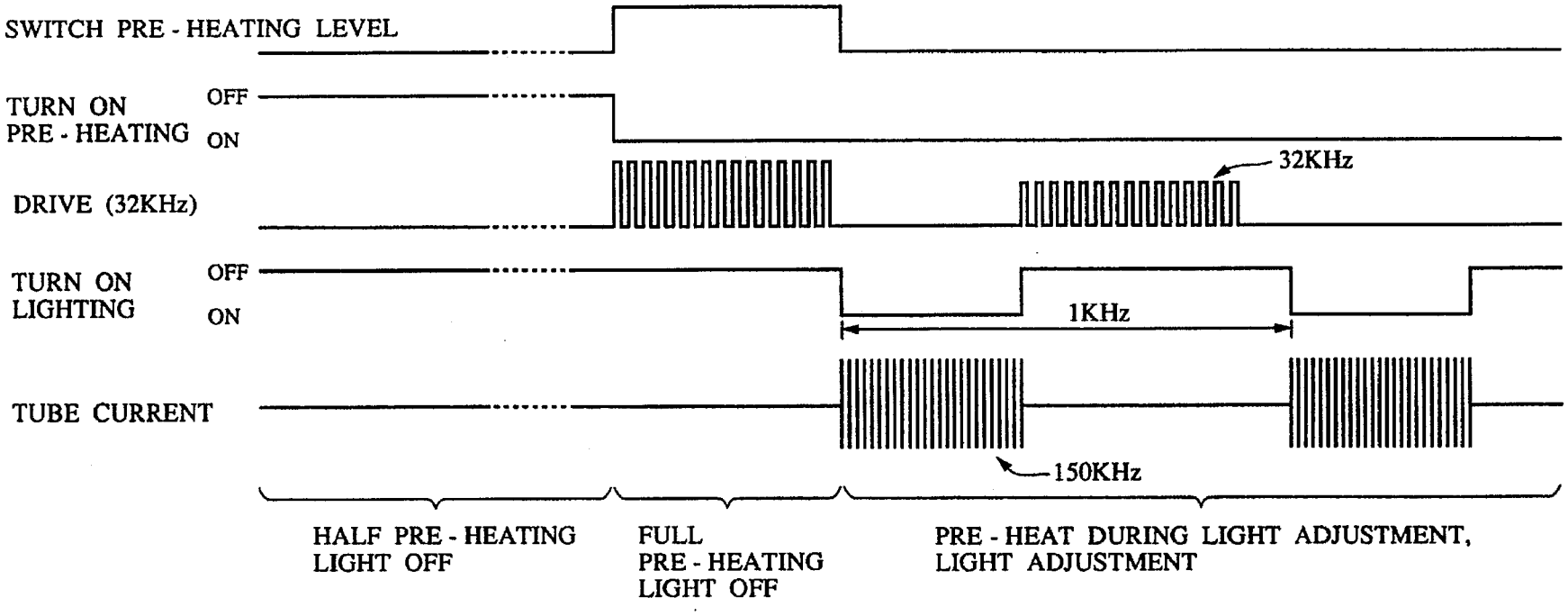
FIG. 6 is a timing chart which illustrates the third embodiment of the present invention.

The foregoing process is shown in FIG. 6 in the form of a timing chart.

When the half pre-heating is performed, the level of the pre-heating level switching signal 45 is lowered. In the foregoing state, the pre-heating turning-on signal 44 is subjected to PWM using a frequency about 100 Hz to obtain a desired effective voltage.

Since this chart starts in state where the level of the pre-heating turning-on signal 44, which is the final signal immediately before the fluorescent lamp 1 is turned on, is high, pre-heating is stopped. Then, the level of the pre-heating level switching signal 45 is raised and the pre-heating turning-on signal 44 is lowered so that the full pre-heating state is realized. Simultaneously with start of the light adjustment process, the level of the pre-heating level switching signal 45 is restored to the low level so that an AC (32 KHz) pre-heating voltage, the amplitude of which is lower than that of the voltage to be applied in the full pre-heating process, is fully applied when the fluorescent lamp 1 is turned off during the light adjustment process.

As in the first embodiment, any temperature ripple, the frequency of which is lower than that in the light adjustment process, is not generated in this embodiment. However, the pre-heating electric current is supplied at a time rate of 100% when the fluorescent lamp 1 is turned off during the light adjustment process, any temperature ripple that is caused from supply/non-supply (pre-heating PWM) of the AC electric current does not take place when the fluorescent lamp 1 is turned off as is experienced with the first embodiment. Since the pre-heating electric current is, without exception, supplied until a moment immediately before the fluorescent lamp 1 is turned on, the turning on operation is performed when the filament temperature has been raised to the highest level. Therefore, this embodiment is effective in a case where the filament temperature must be controlled more precisely during the light adjustment process.

Fourth Embodiment

The third embodiment enables the filaments to be pre-heated precisely while preventing the temperature ripple as compared with the first and second embodiments. The third embodiment comprises the variable-voltage chopper circuit to switch the power supply voltage for the circuit for driving the pre-heating transformer. This fourth embodiment is adapted to a method that does not comprise the chopper circuit.

Figure 7:
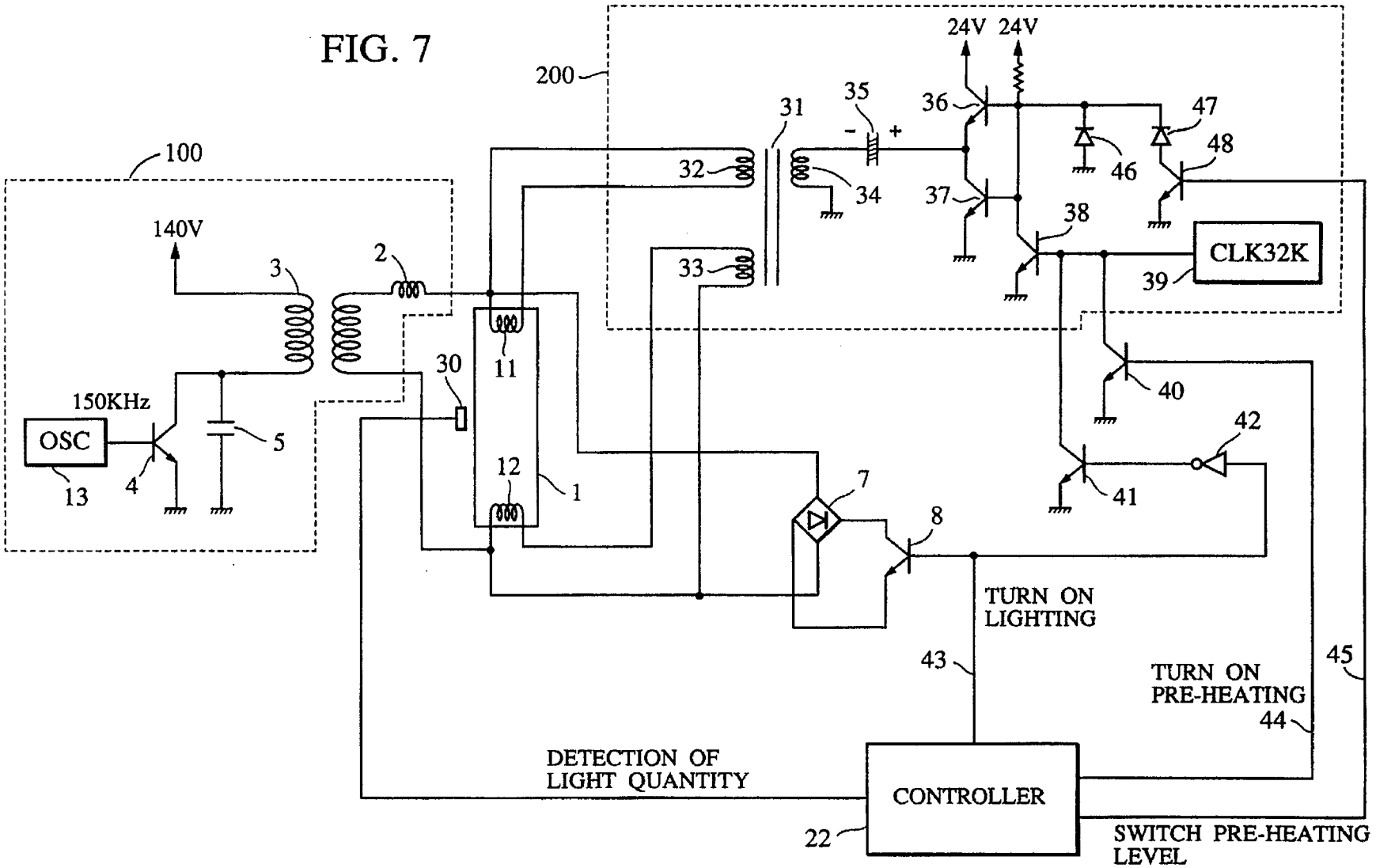
FIG. 7 is a block diagram which illustrates a fourth embodiment of the present invention.

Referring to FIG. 7, this embodiment will now be described. The same structures as those shown in FIG. 5 are given the same reference numerals. When the full pre-heating is performed before the fluorescent lamp 1 is turned on, the level of the pre-heating level switching signal 45 is lowered. Therefore, the transistor 48 is turned off causing a Zener diode 47 to be brought into an open state. Thus, the turning-off voltage (=0 V) for the transistor 38 and the turning-on voltage (20 V in this embodiment) are switched at 32 KHz and applied to the input portion (bases 36 and 37) of a push pull circuit, which is the final stage of the drive circuit for the pre-heating transformer 34. The foregoing voltage is applied to the pre-heating transformer 31 through an AC coupling capacitor 35.

When the light adjustment process is then performed, the level of the pre-heating level switching signal 45 is raised and thus the transistor 48 is turned on. Therefore, the Zener diode 47 having a turning-on voltage (12 V in this embodiment) lower than that of a Zener diode 46 is turned on. Thus, a signal, which is switched between 0 V and 12 V at 32 KHz, is supplied to the input portion of the push pull circuit when the fluorescent lamp 1 is turned off during the light adjustment process.

As described above, the signal to be supplied to the drive circuit for the pre-heating transformer 31 is switched in this embodiment. Thus, the amplitude of the output voltage from the pre-heating transformer 31 is changed, thus providing an effect of simplifying the circuit for switching the pre-heating electric power. However, an NPN transistor constituting the push pull circuit, which is a driver for the pre-heating transformer 31, loses the electric power and therefore a means for preventing a rise in the temperature must be employed.

Fifth Embodiment

This embodiment is characterized by the tube electric current flowing from the first drive circuit 100 into the second drive circuit 200 in such a manner that the two output coils 32 and 33 for the pre-heating transformer generate magnetic fluxes in the same direction on the cores by connecting the following elements:

(1) Two output coils 32 and 33 for the pre-heating transformer serving as the second drive circuit;

(2) The first drive circuit 100 for generating the tube electric current; and (3) The two filaments 11 and 12 of the fluorescent lamp 1.

The foregoing connection will now be described with reference to FIG. 8.

Figure 8:
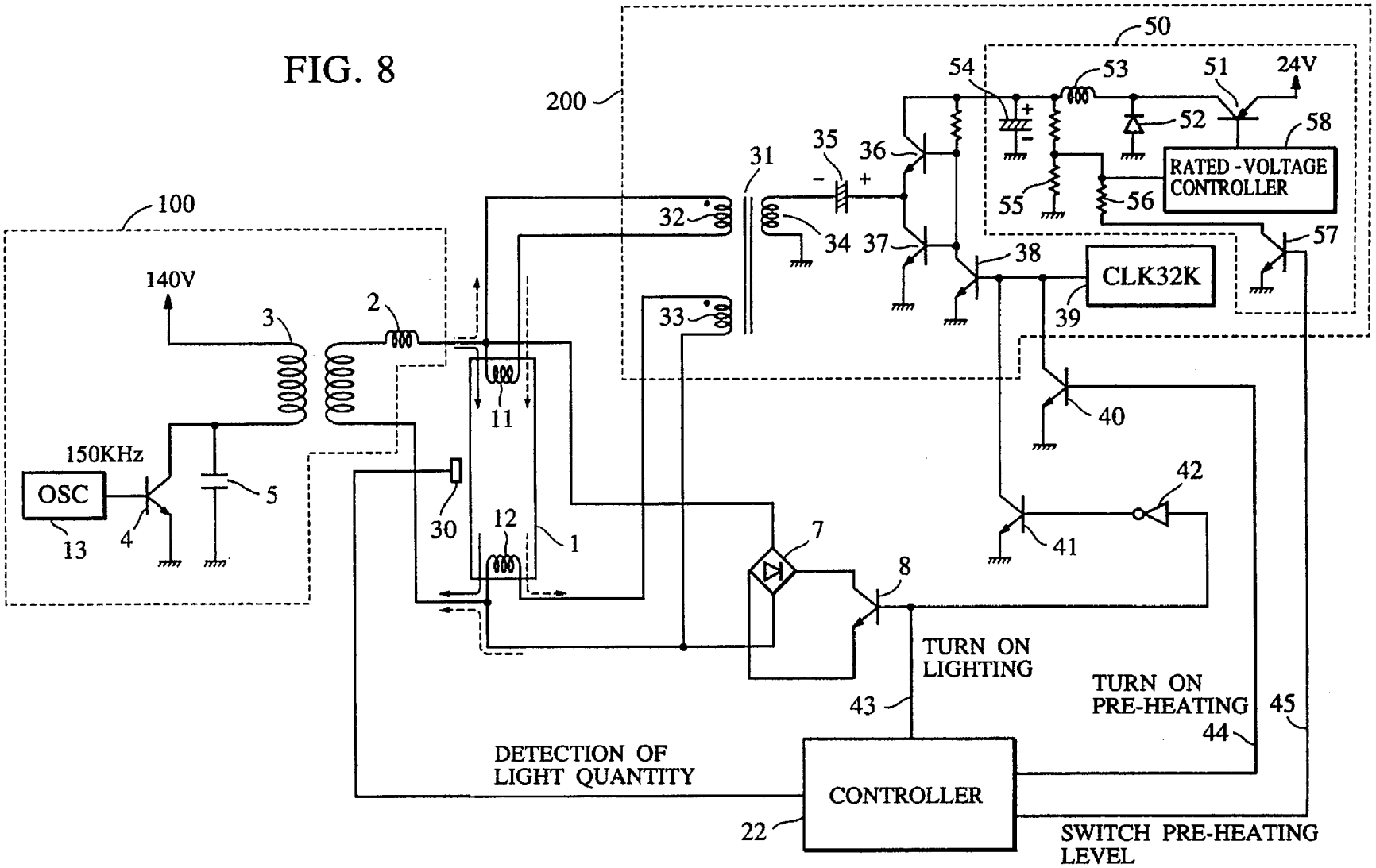
FIG. 8 is a block diagram which illustrates a fifth embodiment of the present invention.

Referring to FIG. 8, the tube electric current supplied from a transformer 3 of the first drive circuit 100 is allowed to pass through the inductor 2. Then, a portion of the tube electric current is directly introduced into the fluorescent lamp 1 as shown by a continuous line and returned to the transformer 3 as shown by a continuous line. Another portion flows in the output coil 32 of the pre-heating transformer 31 serving as the second drive circuit 200 as shown by an arrow of a dashed line before it is formed into a tube electric current. At another end of the fluorescent lamp 1, the tube electric current flows in the other output coil 33 of the pre-heating transformer 31 and then it returns to the transformer 3.

The ratio of current division into the electric current passage shown by the continuous line and that shown by the dashed line is, of course, determined in accordance with the impedance of each of the electric current passages. Since this embodiment has the arrangement that the output coils 32 and 33 of the pre-heating transformer 31 are connected in such a manner that the magnetic fluxes generated due to the flow-in electric currents run in the same direction, the impedance appears due to the inductance of the output coils 32 and 33 of the pre-heating transformer 31. Thus, the major portion of the electric current directly flows in the fluorescent lamp 1 as the tube electric current. Therefore, the discharges points of the filaments 11 and 12 are substantially converged at one point.

Figure 9:
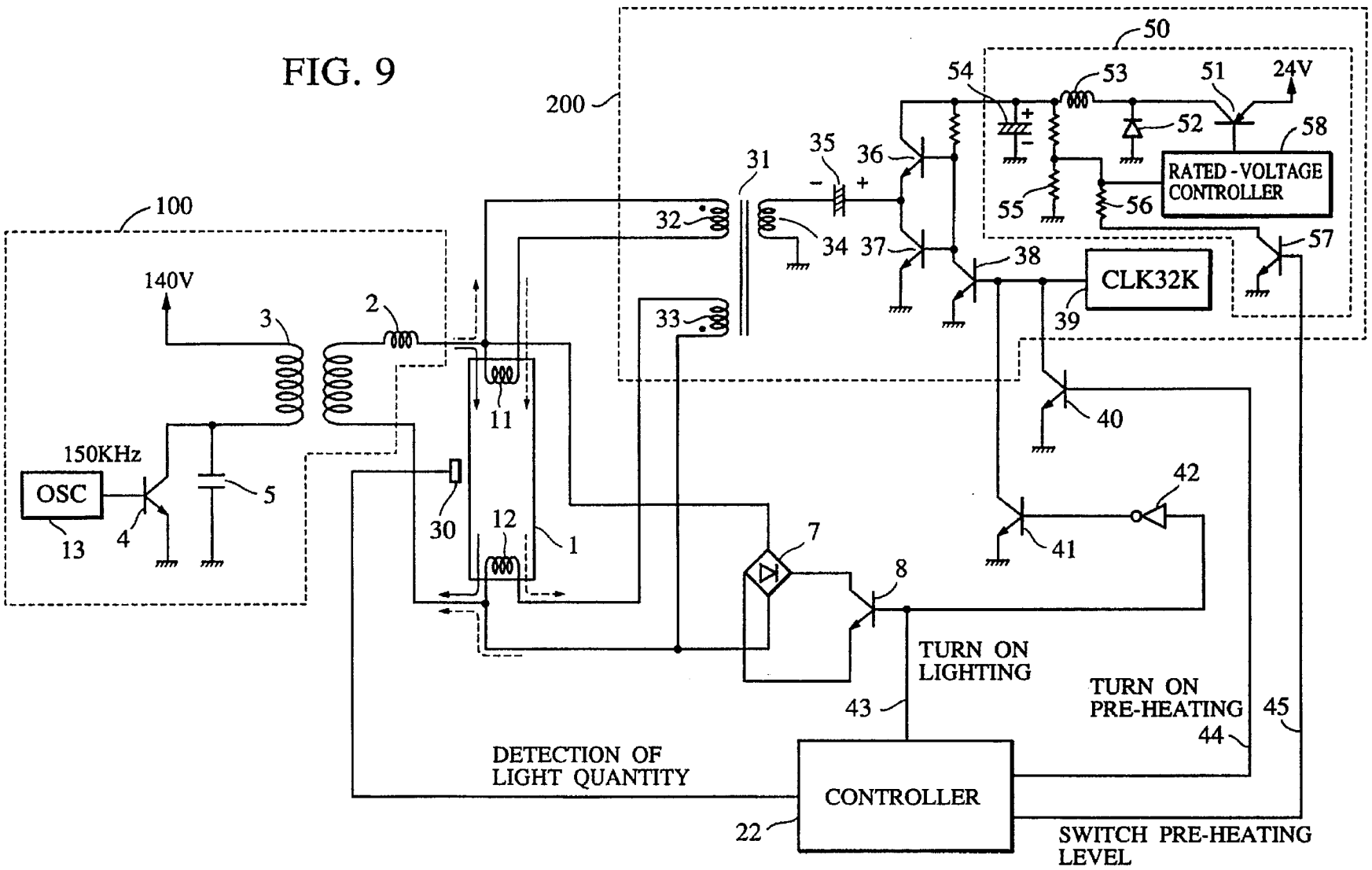
FIG. 9 is a block diagram which illustrates the fifth embodiment of the present invention.

If the connection method is, as shown in FIG. 9, made contrary to that shown in FIG. 8, the magnetic fluxes generated in the output coils 32 and 33 of the pre-heating transformer 31 run in the opposite directions and cancel each other. As a result, the inductance substantially disappears and the impedance is greatly reduced. Thus, the portion directly serving as the tube electric current and the portion serving as the tube electric current after it passes through the pre-heating transformer 31 are at the same level, thus raising a possibility of respectively forming two discharge points on the filaments 11 and 12. Therefore, the life of the filaments may be adversely affected.

This embodiment has the arrangement that the electric current flowing from the first drive circuit 100 and bypassing the output coils 32 and 33 of the pre-heating transformer 31 is the tube electric current and is generated such that the magnetic fluxes respectively generated in the output coils 32 and 33 run in the same direction. This is done by arranging the connection among the output coils 32 and 33 of the pre-heating transformer 31 and the filaments 11 and 12 of the fluorescent lamp 1 as shown in FIG. 8. Thus, the bypass electric current can be minimized and the discharge points on the filaments 11 and 12 can be converged into one point. Therefore, the life of the filaments 11 and 12 can be lengthened.

As described above, this embodiment comprises the second drive circuit including a high-frequency transformer having two or more outputs for supplying the AC pre-heating electric currents to the activating filaments and controllable individually from the main drive circuit for supplying the electric current to the light emitting tube. Thus, the electric power level for pre-heating the filaments controlled by the second drive circuit is switched between the period in which the tube electric current is turned on and the period in which the same is turned off when the light adjustment is performed by turning on/off the tube electric current at the high frequency and between the period in which the fluorescent lamp 1 is turned off and the light adjustment period when the apparatus is in the standby mode. Therefore, the life of the filaments of the fluorescent lamp can be lengthened, blacking of the tube surface can be prevented, and the life of the light quantity and the light quantity in the direction of the tube can be made more uniform.

Furthermore, the electric power level for pre-heating the filaments controlled by the second drive circuit is switched between the period in which the tube electric current is turned on and the period in which the same is turned off when the light adjustment is performed by turning on/off the tube electric current at the high frequency or the same is switched in accordance with the ratio of the period in which the tube electric current is turned on and the period in which the same is turned off at the light adjustment process. Thus, the filament temperature at the light adjustment process can be precisely controlled at an adequate level.

Figure 5:
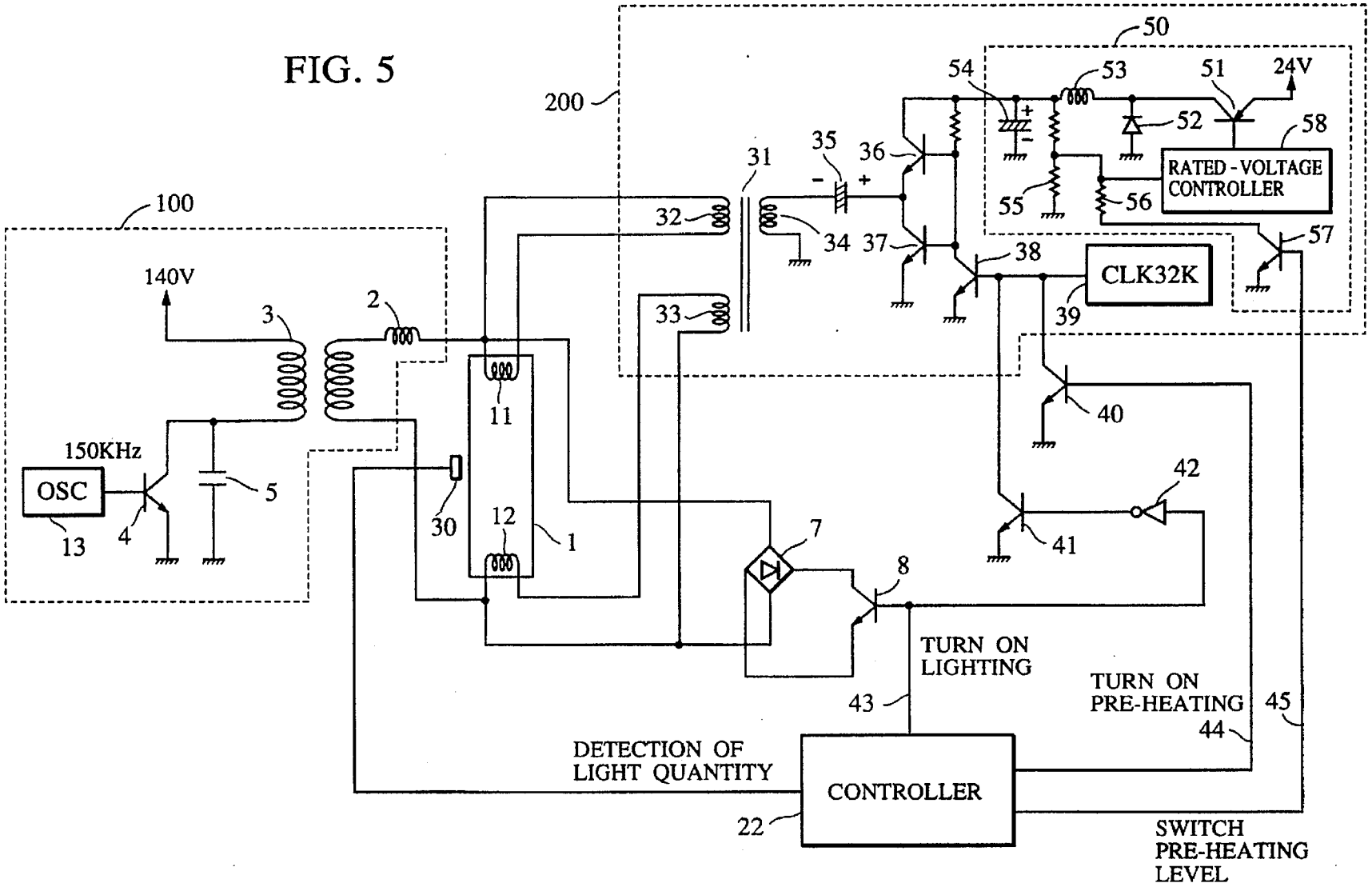
FIG. 5 is a block diagram which illustrates a third embodiment of the present invention.
Figure 10:
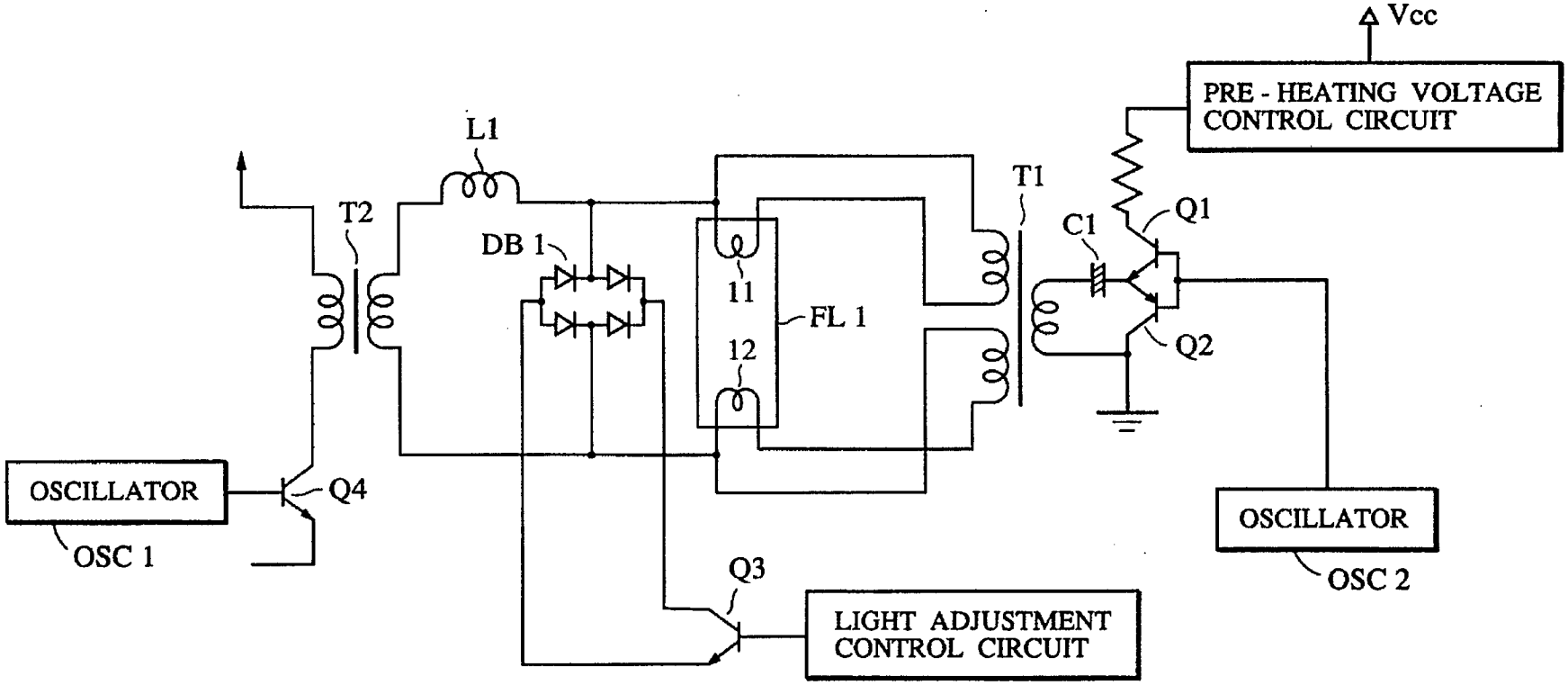
FIG. 10 is a diagram which illustrates a circuit in an apparatus for turning on a fluorescent lamp.

The structure for changing the level for pre-heating the filaments of the fluorescent lamp according to the third and the fifth embodiment shown in FIGS. 5 and 8 can be illustrated simply as shown in FIG. 10.

Referring to FIG. 10, a circuit for turning on the fluorescent lamp FL1 turns a transistor Q4 on and off in response to an input made from an oscillator OSC1 disposed on the primary side thereof to operate the inverter transformer T2. A high frequency voltage emitted from the secondary side is allowed to pass through a fluorescent lamp turning on electric current limiting inductance L1 and connected to the filaments 11 and 12 at the two ends of the fluorescent lamp FL1. A diode bridge DB1 is connected to each of the two ends of the fluorescent lamp FL1 and the fluorescent lamp FL1 is turned on/off by a transistor Q3. Note that a transformer T1 is provided for supplying pre-heating electric current to the filaments 11 and 12 of the fluorescent lamp FL1.

The fluorescent lamp turning on unit to be provided for an image forming apparatus must be capable of precisely controlling pre-heating of the filaments 11 and 12 in order to instantaneously turn on the fluorescent lamp and to lengthen the life of the same as described above. Therefore, it is preferable that the structure of it be as shown in the circuit diagram of FIG. 10.

The secondary coil of the pre-heating transformer T1 is connected to the filaments 11 and 12 of the fluorescent lamp FL1. Thus, sine waves or rectangular waves are supplied to the primary coil, and the pre-heating transformer T1 insulates it so as to pre-heat the filaments 11 and 12 by the sine waves or the rectangular waves. Furthermore, the amplitude of the wave supplied to the primary side is controlled. Thus, the filament temperature can be controlled to an adequate level.

The structure shown in FIG. 10 involves generation of temperature ripples because the AC power source is used to perform pre-heating, thus resulting in that the life is shortened. In addition, a circuit for controlling the wave height must be provided, thus sometimes raising a problem in that the cost cannot be reduced. Moreover, the AC voltage is used to perform pre-heating and therefore precise control cannot be performed. Furthermore, it is possible that the filaments cannot quickly be heated and the time required to complete the pre-heating operation to be performed before the fluorescent lamp is turned on cannot easily be shortened.

It might therefore be considered feasible to employ a DC power source to perform pre-heating.

Figure 11:
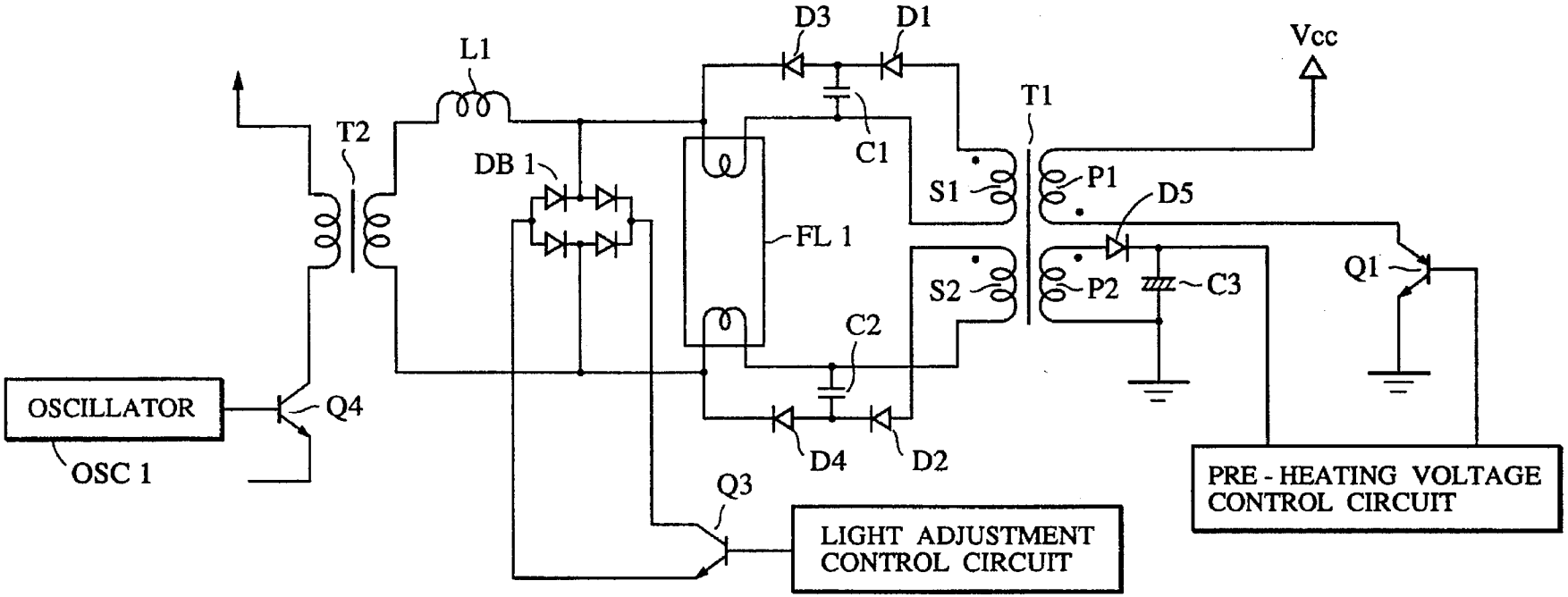
FIG. 11 is a diagram which illustrates a circuit in an apparatus for turning on a fluorescent lamp.

FIG. 11 is a circuit diagram which illustrates an example of a pre-heating circuit employing a DC power source.

Referring to FIG. 11, rectifying diodes D1 to D4 and ripple removing capacitors C1 and C2 are disposed between the pre-heating transformer T1 and the filaments 11 and 12.

The operation for pre-heating the filaments by means of the DC power source is able to completely remove the temperature ripple of the filaments, lengthen the life of the fluorescent lamp, realize the precise control of the pre-heating voltage and shorten the time required to complete pre-heating before the fluorescent lamp is turned on. Thus, the cost can be reduced as compared with the example shown in FIG. 10.

However, it raises a problem of reducing the life of the fluorescent lamp in a case where the pre-heating voltage must be controlled to a plurality of voltage levels as described later because the difference between the time constant of the load and that of the detection system deteriorates the transition response characteristics, generating a period in which precise pre-heating voltage control cannot be performed.

In order to overcome the foregoing problem, and achieve precise control of the pre-heating voltage to be applied to the filaments of the fluorescent lamp, while realizing excellent responsiveness and preventing temperature ripple of the filaments, a device for turning on a fluorescent lamp will now be described.

Sixth Embodiment

Figure 12:
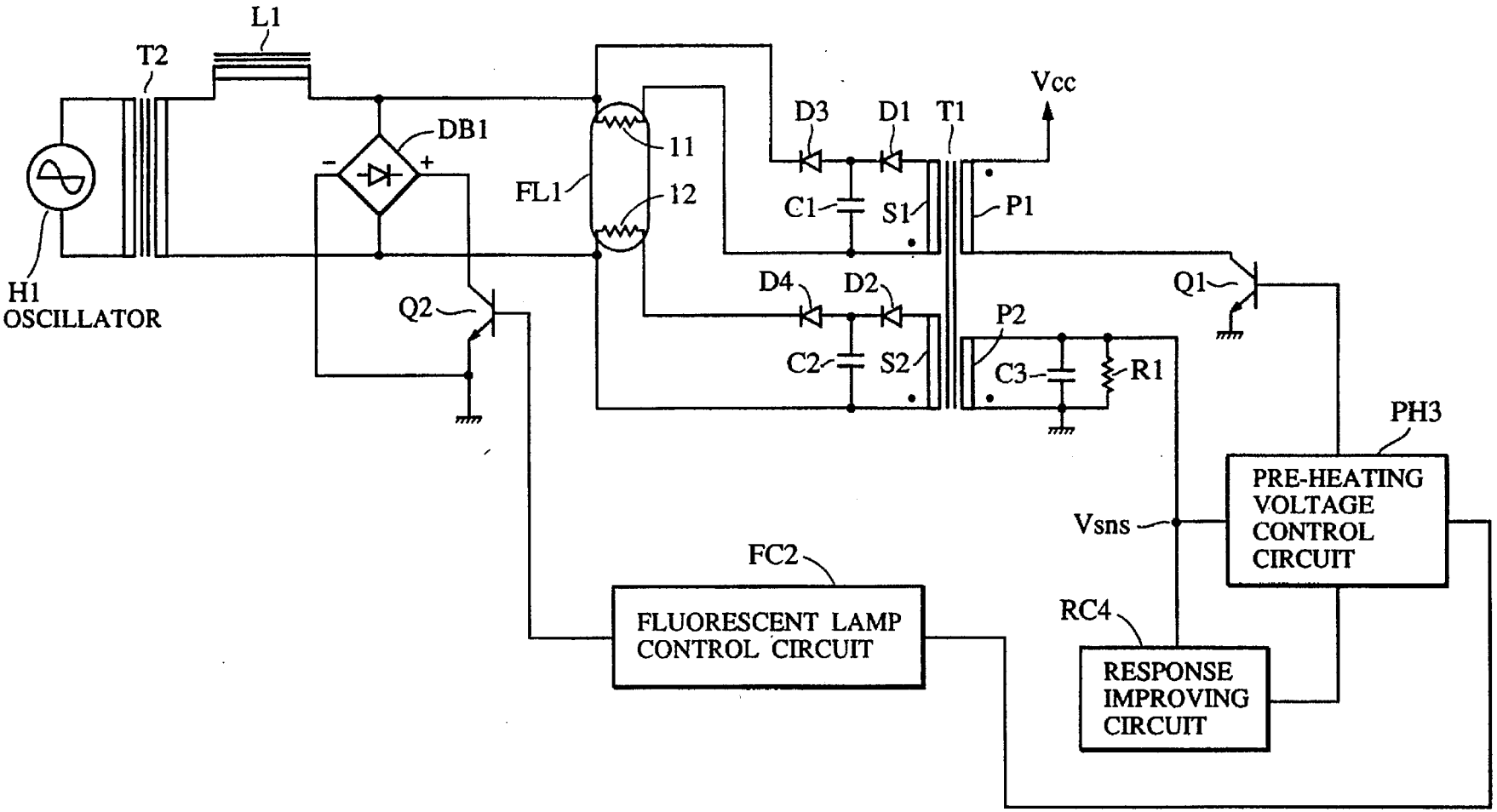
FIG. 12 is a circuit diagram according to a sixth embodiment of the present invention.

FIG. 12 is a circuit diagram which illustrates a sixth embodiment of an apparatus for turning on a fluorescent lamp of an image forming apparatus according to a sixth embodiment of the present invention. Referring to FIG. 12, the same or corresponding elements to those shown in FIG. 10 or FIG. 11 are given the same reference numerals.

Referring to FIG. 12, the structure and operation of the sixth embodiment will now be described.

The inverter transformer T2 for a fluorescent lamp is operated by an oscillator H1 so as to generate, on the secondary side thereof, desired high-frequency high voltage AC waves determined by the characteristics of the fluorescent lamp FL1. The output from the transformer T2 is connected to the filaments 11 and 12 disposed at the two ends of the fluorescent lamp FL1 through the fluorescent lamp turning on electric current limiting inductance L1. In general, a fluorescent lamp can be shifted from the turned off state to the turned on state with a voltage which is in direct proportion to the length of the fluorescent lamp and which is in inverse proportion to the diameter of the same. Since the impedance is lowered when the fluorescent lamp has been shifted to the turned-on state, an electric current limiting device is required to maintain the turned on state and to limit the electric current to a value with which the required maximum light quantity can be obtained. In this embodiment, the inductance L1 is the electric current limiting device.

Furthermore, shunt switches each consisting of the diode bridge DB1 and the transistor Q2 are connected to the two ends of the fluorescent lamp FL1. When the transistor Q2 is turned on, the output from the transformer T2 is not supplied to the fluorescent lamp FL1. Therefore, the fluorescent lamp FL1 is brought into the turned off state. When the transistor Q2 is turned off, the output from the transformer T2 is supplied to the fluorescent lamp FL1 so that the fluorescent lamp FL1 is turned on.

The transistor Q2 is PWM-controlled by a fluorescent lamp control circuit FC2 in such a manner that the output from, for example, a light quantity sensor (not shown) is made to be a predetermined value. That is, the arrangement permitting the on/off duty cycle of the transistor Q2 to be variable to enable the fluorescent lamp FL1 to be adequately turned on/off. Thus, the light quantity of the fluorescent lamp FL1 can be maintained at a predetermined value.

The transformer T1 is a flyback converter transformer T for pre-heating a filament. In order to shift the fluorescent lamp from the turned off state to the turned on state quickly and to maintain the long life as described above, the filaments 11 and 12 must be heated to a predetermined level to cause electron emitting substances applied on the surfaces of the filaments 11 and 12 to be easily emitted and to minimize removal and consumption of the electron emitting substances. Therefore, the electric power to be supplied to the two ends of each of the filaments 11 and 12 is controlled by the transformer T1.

An end of primary coil P1 of the transformer T1 is connected to power supply voltage Vcc, while another end of the same is connected to the collector of the transistor Q1 serving as a switching device. The emitter of the transistor Q1 is grounded. Secondary coils S1 and S2 of the transformer T1 are rectified and smoothed by diodes D1, D2, capacitors C1 and C2 resulting in a DC voltage. Diodes D3 and D4 prevent current back flow before the DC voltage is connected to each of the filaments 11 and 12 of the fluorescent lamp FL1.

Furthermore, the transformer T1 has a detection coil P2. The output from the detection coil P2 is rectified and smoothed by a diode D5 and a capacitor C3 so as to be formed into DC voltage, output Vsns, representing the result of the detection. Note that resistor R1 is provided to adjust the loop response characteristics of the control. The detection result output Vsns is able to accurately reflect the voltage generated in the secondary coils S1 and S2. By PWM-controlling the transistor Q1 in such a manner that the foregoing voltage level is stabilized to a predetermined value by a pre-heating voltage control circuit PH3, the filament pre-heating DC voltage obtained by rectifying and smoothing the voltage generated in the secondary coils S1 and S2 by the foregoing elements D1, C1, D3, D2, C2 and D4 can be accurately controlled to a predetermined value.

The relationship between pre-heating of the filaments and the turning on control will now be described in further detail. In order to raise the filament temperature to a level at which the fluorescent lamp can be turned on stably, before the fluorescent lamp is turned on, pre-heating voltage (called "full pre-heating") is applied. In a completely turned off state, the time required to raise the temperature of the filaments to the foregoing level is shortened by applying half of the pre-heating voltage (called "half pre-heating").

Furthermore, the duty cycle of the transistor Q2 is controlled in such a manner that the fluorescent lamp control circuit FC2 causes a predetermined light quantity to be emitted during the period in which the fluorescent lamp is turned on. Thus, the fluorescent lamp repeatedly turns on/off. Therefore, the filament temperature is stabilized (called "turning on pre-heating") by applying pre-heating voltage by a predetermined quantity during the period in which the fluorescent lamp is turned off. The optimum value of the pre-heating voltage during the period, in which turning of the fluorescent lamp is controlled, is changed in accordance with the turning on duty cycle in the strict sense. However, the pre-heating voltage is usually only required to be included in a latitude range of the optimum values. That is, the pre-heating voltage control circuit PH3 must perform at least ternary-value control (at least binary-value control if shortening of the time is not required) and instantaneously change the voltage to be controlled. However, the filament load is about several ohms. Therefore, even if the aimed value to be controlled is changed with the time constant of the detection result output when the full pre-heating mode is shifted to the turning on pre-heating mode, pre-heating is undesirably stopped while the detection result output is lowered to the desired value. Accordingly, this embodiment comprises a response improving circuit RC4 so that the capacitor C3 is rapidly discharged if the desired value has been reduced so as to instantaneously change the desired value.

Figure 13:
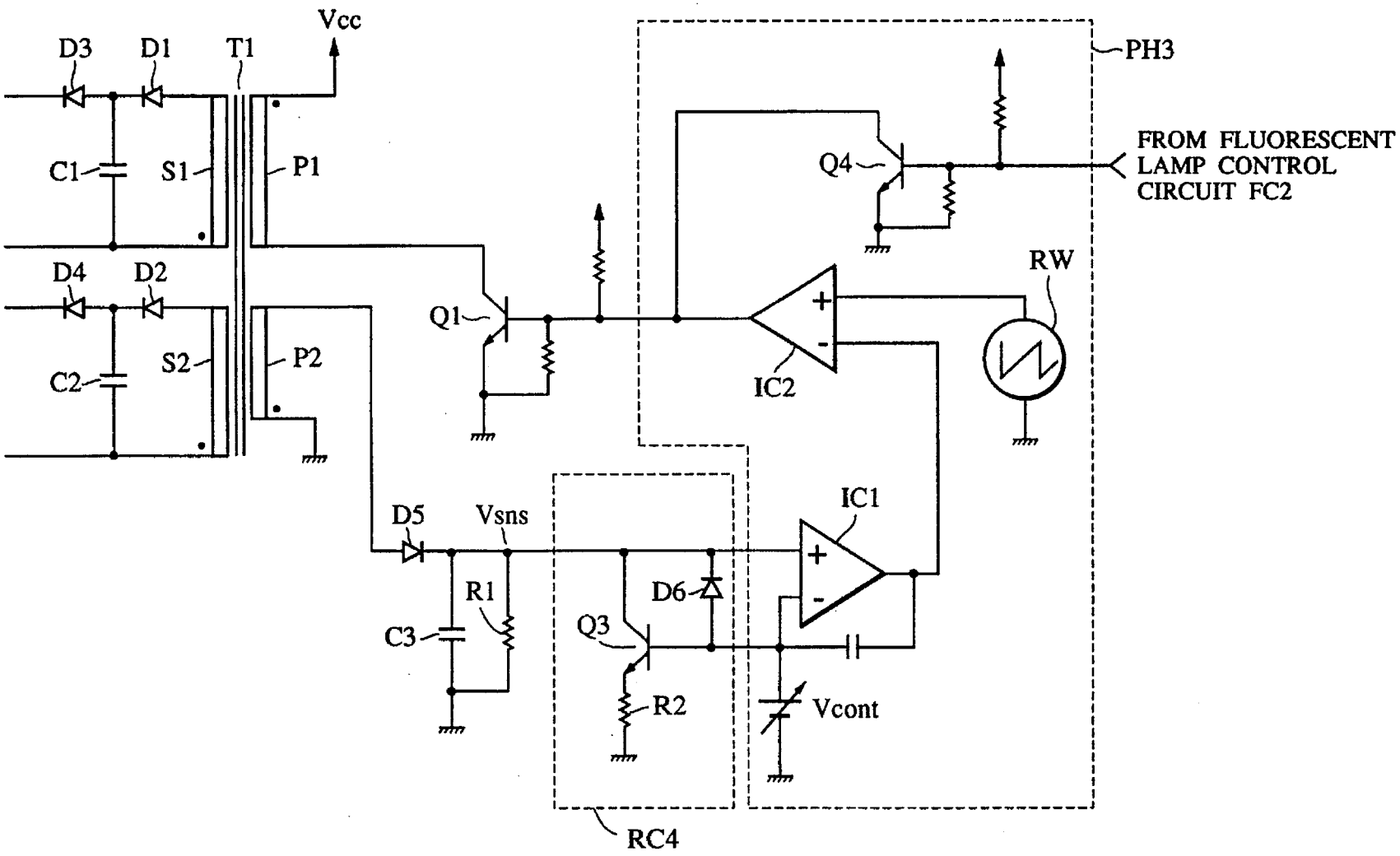
FIG. 13 is a circuit diagram which illustrates the primary side of a transformer T1 according to the sixth embodiment of the present invention.

The pre-heating voltage control circuit PH3 and the response improving circuit RC4 are arranged, for example, as shown in FIG. 13. The same elements as those of the foregoing embodiments are given the same reference numerals.

The detection result output Vsns is input to an error amplifier IC1, and compares with desired control value Vcont and amplified. The output from the error amplifier IC1 is compared to a ramp waveform (RW) in an error amplifier IC2. The output from the error amplifier IC2 representing the result of the comparison, PWM waveform, operates the transistor Q1. Furthermore, the output of transistor Q4 operates the transistor Q1 in response to a signal supplied from the fluorescent lamp control circuit FC2 during a period in which the fluorescent lamp is turned off.

As a result of the foregoing operation, the pre-heating voltage is controlled to the level that corresponds to the aimed control value Vcont. Although a resistor R1 is inserted in parallel to the capacitor C3 for the purpose of adjusting the control stability as described above, its effect is limited to maintaining stability after the control has achieved the desired value. Therefore, a discharge effect cannot be obtained in a state of transition. Accordingly, if the aimed control value has been reduced, as in a case where Vcont is changed from the full pre-heating state to the turning on pre-heating state, the charges of the capacitors C1 and C2 are discharged in a short time because the filament load is low in the circuit shown in FIG. 13, as the response improving circuit RC4 (to be described later) is not provided. On the other hand, since the charge registered on the capacitor C3 is only discharged through the resistor R1, the level of the output from the error amplifier IC1 is maintained at a high level until the detection signal Vsns is lowered to the desired control value Vcont. As a result, the PWM signal is stopped. Thus the time in which pre-heating is not performed is continued for a relatively long time.

Accordingly, a response improving circuit RC4 is utilized. It is constituted by a PNP transistor Q3 having an emitter which receives the detection output Vsns and which is connected to the positive input of the error amplifier IC1, a base connected to the negative input of the error amplifier IC1 and a collector grounded through the resistor R2, and a protecting diode D6 connected in a direction opposing the direction between the emitter and the base of the transistor Q3.

In a stationary state in which the control value is controlled to an aimed value, the positive/negative input of the error amplifier IC1 is in an imaginary short state. Therefore, the added response improving circuit RC4 is not operated and thus the original operation of the pre-heating voltage control circuit PH3 is not inhibited. When Vcont is changed in such a manner that the full pre-heating state is shifted to the turning on pre-heating state, the charges stored in the capacitors C1 and C2 are discharged in a very short time because the impedance of the filament is low. On the other hand, the charge of the capacitor C3 is discharged through the resistor R1 and it is lowered slowly. Therefore, it is not substantially changed instantaneously and thus the error amplifier IC1 is brought into a saturated state. Thus, the PWM signal is stopped. However, when the potential difference between Vcont and Vsns exceeds Vbe of the transistor Q3, the transistor Q3 is turned on and is grounded through the resistor R2 having a value which is sufficiently lower than the resistor R1 and which does not exceed the maximum rated value for the transistor Q3. Therefore, the charge of the capacitor C3 is rapidly discharged and thus the detection signal Vsns rapidly approaches the aimed control value Vcont.

When the potential difference between the aimed control value Vcont and the detection signal Vsns is smaller than Vbe of the transistor Q3, the transistor Q3 is turned off. Then, the charge of the capacitor C3 is again discharged through the resistor R1 until the potential of Vsns and that of Vcont are made to be substantially the same. Thus, the error amplifier IC1 is shifted from the saturated state to a controlled state in which the error amplifier IC1 transmits the PWM signal.

Although a period in which the PWM signal is stopped is present in this embodiment, the stop time can sufficiently be shortened to a level at which the life of the filament is not affected. Furthermore, by setting the constant to an optimum value, the waveform affected by the period, as shown in FIG. 14(*a*), in which the PWM signal is stopped, is not formed when the filament is observed because the waveform of the voltage to be applied to the filament has a unique time constant. However, the voltage to be applied to the filament can be smoothly shifted as shown in FIG. 14(*b*).

As described above, respective predetermined potentials corresponding to the full pre-heating, half pre-heating and turning on pre-heating modes can be smoothly switched and stably applied to the filaments of a fluorescent lamp. Thus, the efficiency of using the fluorescent lamp can be improved and the life of the fluorescent lamp can be lengthened.

Seventh Embodiment

FIG. 15 is a circuit diagram which illustrates an essential portion of a filament pre-heating power source control portion of a fluorescent lamp turning apparatus according to a seventh embodiment of the present invention for turning on and controlling a fluorescent lamp provided in an image forming apparatus. The same or corresponding elements to those of the sixth embodiment are given the same reference numerals.

Since the residual elements are arranged similarly to those of the sixth embodiment, they are omitted from illustration. The characteristic structure and operation of the seventh embodiment will now be described with reference to FIG. 15.

As in to the sixth embodiment, the output from the detection coil P2 is rectified and smoothed by the diode D5 and the capacitor C3. The DC voltage level is divided by the resistors R3 and R4 and applied to the error amplifier IC1 as the detection signal Vsns.

If an adequate voltage, which can directly be applied to the error amplifier, can be set, a structure similar to the sixth embodiment can be employed in place of the voltage dividing structure. However, the structure cannot easily be constructed in many cases due to the relationship between the aimed control value Vcont, the output and the coil ratio of the detection coil. The structure according to this embodiment enables a circuit to be constructed relatively easily by using the resistors R3 and R4. The output of the result of the smoothing process is, through the discharging resistor R2, connected to the collector of a transistor Q5 which is a discharging switch. The emitter of the transistor Q5 is grounded, while the base of the same is grounded through a resistor R6. The detection result output Vsns is connected to the emitter of the PNP transistor Q3, while the collector of the transistor Q3 is connected to the base of the discharging switch Q5. The base is connected to the control input (the negative input) of the error amplifier IC1. Furthermore, a protection diode D6 is connected between the base and the emitter of the transistor Q3 in an opposite direction.

As in to the sixth embodiment, the positive/negative input of the error amplifier IC1 is in an imaginary short state and in a stationary state in which the control value is controlled to the aimed value. The added response improving circuit RC4 is not operated and therefore the original operation of the pre-heating voltage control circuit RH3 is not interrupted.

If the aimed control value Vcont is changed in such a manner that the full pre-heating state is shifted to the turning on pre-heating state, the charges stored in the output-side capacitors C1 and C2 can be discharged in a significantly short time because the impedance of the filament is low.

Since the charge of the capacitor C3 on the control side is discharged through a synthesized resistor of the resistors R3 and R4 and therefore it is lowered slowly, the charge is not substantially instantaneously changed. Therefore, the error amplifier IC1 is brought into a saturated state, causing the PWM signal to be stopped. If the potential difference between the aimed control value Vcont and the detection signal Vsns exceed Vbe of the transistor Q3, the transistor Q3 is turned on and a base electric current is supplied to the transistor Q5 through the resistor R5 so that the transistor Q5 is turned on. As a result, the output representing the result of smoothing is grounded through the resistor R2 having a value which is sufficiently smaller than the synthesized resistance of the resistors R3 and R4 and which does not exceed the maximum rated value for the transistor Q3. Therefore, the charge of the capacitor C3 is rapidly discharged and the detection signal Vsns rapidly approaches the aimed control value Vcont.

When the potential difference between Vcont and Vsns is lower than Vbe of the transistor Q3, the transistor Q3 is turned off. As a result, also the transistor Q5 is turned off. Then, the charge of the capacitor C3 is again discharged through the synthesized resistance of the resistors R3 and R4. When the potential of the detection signal Vsns and that of the aimed control value Vcont have been made to be substantially the same, the error amplifier IC1 is suspended from the saturated state into a controlled state in which the error amplifier IC1 generates the PWM signal.

In contrast with the sixth embodiment in which the transistor Q3 serves as a comparator having an insensitive zone of Vbe and a discharging switch, the seventh embodiment has the structure in which the functions are separated such that the transistor Q3 is a comparator having the insensitive zone of Vbe and the transistor Q5 serves as the discharging switch.

As described above, predetermined potentials corresponding to the full pre-heating, half pre-heating and turning on pre-heating can further smoothly be switched and stably applied to the filaments of a fluorescent lamp as compared with the sixth embodiment. Therefore, the efficiency of using the fluorescent lamp can be improved and the life can be lengthened.

Eighth Embodiment

Figure 16:
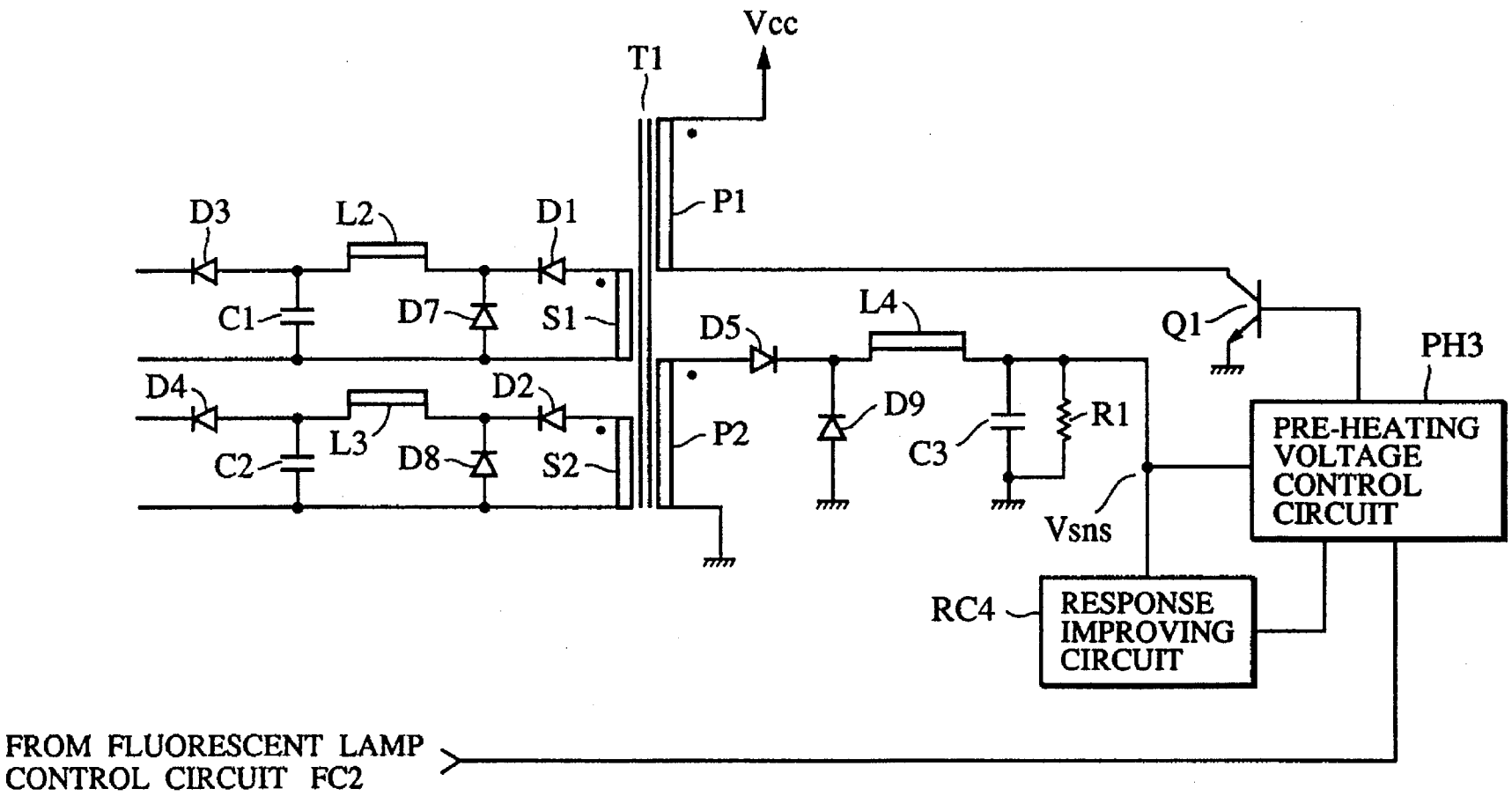
FIG. 16 is a circuit diagram which illustrates a portion of an eighth embodiment of the present invention.
Figure 17:
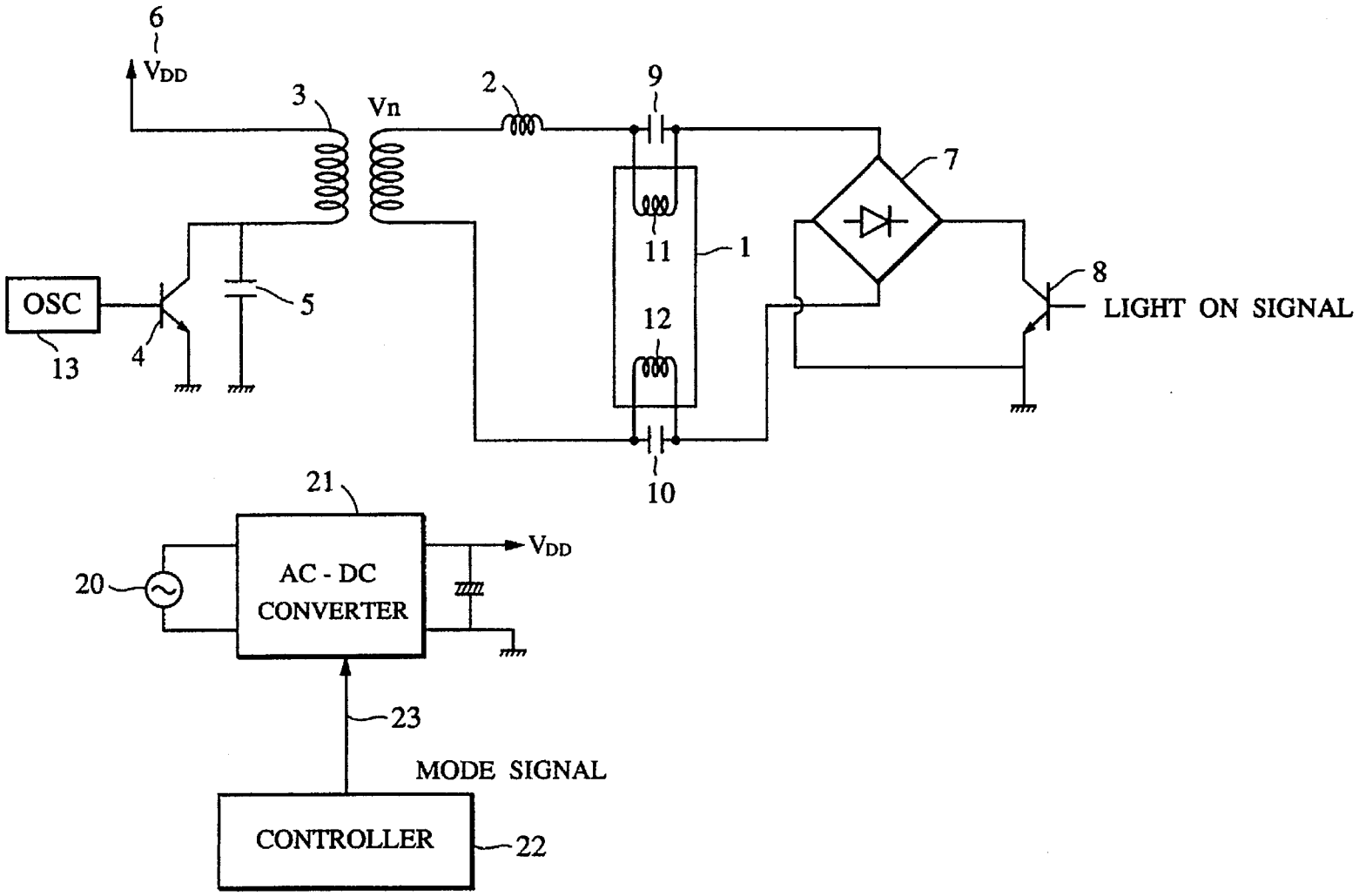
FIG. 17 is a block diagram which illustrates an example of the structure of a conventional apparatus.
Figure 18:
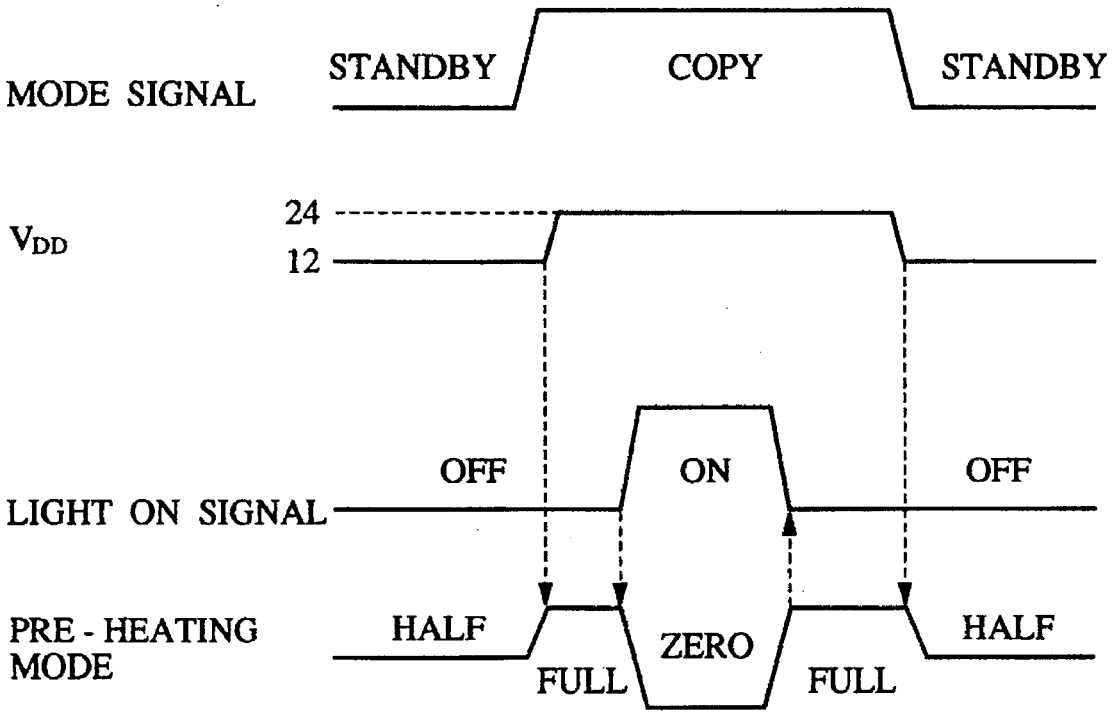
FIG. 18 is a timing chart which illustrates the operation of the conventional apparatus.

FIG. 16 is a circuit diagram which illustrates an essential portion of a power supply portion for pre-heating filaments of a fluorescent lamp turning on apparatus according to an eighth embodiment of the present invention for turning on and controlling a fluorescent lamp provided in an image forming apparatus. The same or corresponding elements to those according to the sixth embodiment or the seventh embodiment are given the same reference numerals.

Those elements arranged similarly to those according to the sixth embodiment are omitted from description. The characteristic structure and operation of the eighth embodiment will now be described with reference to FIG. 16.

As contrasted with the sixth embodiment in which the transformer T1 for pre-heating the filaments and having the input coil P1, the output coils S1 and S2 and the detection coil P2 is arranged to be a flyback-type regulator mode, the eighth embodiment comprises the transformer arranged to be a forward-type regular mode. Since the operation of the circuit is arranged similarly to the usual forward-type regulator and the control operation and effect are the same as those of the sixth embodiment, their descriptions are omitted here.

Since this embodiment comprises the flyback type transformer, the main parameter for designing the transformer is the ratio of the number of windings in a case where an application adapted to relatively small electric power. As contrasted with the forward-type transformer which must be designed to consider the primary inductance, design of the flyback-type transformer can easily be performed. In addition, the dispersion of the characteristics of the transformer does not affect the output, thus providing an effect that the control stability can be improved.

Embodiment of Image Forming Apparatus

The image forming apparatus comprising the foregoing apparatus for turning on a fluorescent lamp is a copying machine or a facsimile machine having the arrangement that the operation of the fluorescent lamp for irradiating a subject, from which an image will be formed, with light is controlled by the apparatus for turning the fluorescent lamp so that the image of a subject, from which an image will be formed, is photoelectrically read to form an image on a recording medium. As a result of the operation and effect of pre-heating the filaments of the apparatus for turning on a fluorescent lamp, the fluorescent lamp can quickly and easily be shifted to the standby mode for waiting for the exposure of an original document, a mode in which the image exposure starts and a state for exposing the image. Therefore, the apparatus for forming an image according to this embodiment is able to stably and effectively operate the fluorescent lamp for a long time to efficiently form an image.

As described above, the waveform of the pre-heating voltage is formed into a DC voltage to precisely control the pre-heating voltage. As a result, temperature ripple of the filaments can completely be prevented and the peak voltage to be applied to the filaments can be lowered. Therefore, glow discharge occurring at the two ends of the filament can be prevented and the time required to complete pre-heating can be shortened. In addition, the transition response characteristics when the control voltage has been changed can be improved. Thus, the life of the fluorescent lamp can be lengthened. As contrasted with the conventional method that comprises the pre-heating voltage control circuit formed into a chopper power source or the like, thus requiring a complicated circuit and an excessively large number of elements, the present invention enables the number of elements to be decreased. Thus, the cost can be reduced and reliability enhanced.

Although the invention has been described in its preferred form with a certain degree of particularly, it is understood that the present disclosure of the preferred form can be changed in the details of construction and the combination and arrangement of parts may be modified without departing from the spirit and the scope of the invention as hereinafter claimed.

What is claimed is:

1. An apparatus for operating a fluorescent lamp comprising:

first power source means for supplying a tube electric current to the fluorescent lamp to turn on the fluorescent lamp;

second power source means for supplying pre-heating electric currents to filaments of the fluorescent lamp; and switching means for switching an electric power level of the pre-heating electric currents to be supplied to the filaments by said second power source means by changing a ratio of supply/non-supply of the pre-heating electric currents to the filaments.

2. An apparatus for operating a fluorescent lamp according to claim 1, wherein said second power source means supplies alternating current to the filaments.

3. An apparatus for operating a fluorescent lamp according to claim 1, wherein said switching means switches the electric power level of the pre-heating electric currents between a period in which the fluorescent lamp is turned off and a period in which the fluorescent lamp is turned on.

4. An apparatus for operating a fluorescent lamp according to claim 1, wherein said switching means switches the electric power level of the pre-heating electric currents after a point immediately before the fluorescent lamp is turned on and a point when the fluorescent lamp is turned on.

5. An apparatus for operating a fluorescent lamp according to claim 1, wherein said second power source means comprises a transformer having a plurality of output coils respectively connected to a plurality of the filaments of the fluorescent lamp and one electric power receiving input coil, and the plurality of output coils of said transformer and the plurality of filaments of the fluorescent lamp being connected in such a manner that magnetic fluxes, which are generated in said output coils from a portion of the electric current supplied from said first power source means bypassing said plurality of output coils of said transformer and formed into a tube electric current, run in the same direction when the fluorescent lamp is turned on.

6. An apparatus for operating a fluorescent lamp comprising:

first power source means for supplying a tube electric current to the fluorescent lamp to turn on the fluorescent lamp;

second power source means for supplying pre-heating electric currents to filaments of the fluorescent lamp; and control means for monitoring an output from said second power source means to control the electric power level of said pre-heating electric currents to be supplied from said second power source means to the filaments by changing a ratio of supply/non-supply of the pre-heating electric currents to the filaments.

7. An apparatus for operating a fluorescent lamp according to claim 6, wherein said second power source means supplies direct current to the filaments.

8. An apparatus for operating a fluorescent lamp according to claim 6, wherein said control means compensates said pre-heating electric currents to be supplied from said second power source means to the filaments in a transition period from a state in which the fluorescent lamp is turned off to a state in which the fluorescent lamp is turned on or from a state in which the fluorescent lamp is turned on to a state in which the fluorescent lamp is turned off.

9. A method of operating a fluorescent lamp comprising the steps of:

supplying a tube electric current to a fluorescent lamp to turn on the fluorescent lamp;

supplying pre-heating electric currents to filaments of the fluorescent lamp; and switching an electric power level of the pre-heating electric currents to be supplied to the filaments by changing a ratio of supply/non-supply of the pre-heating electric currents to the filaments.

10. A method of operating a fluorescent lamp according to claim 9, wherein, in said step of supplying pre-heating electric currents, alternating current is supplied to the filaments.

11. A method of operating a fluorescent lamp according to claim 9, wherein, in said switching step, the electric power level of the pre-heating electric currents is switched between a period in which the fluorescent lamp is turned off and a period in which the fluorescent lamp is turned on.

12. A method of operating a fluorescent lamp according to claim 9, wherein, in said switching step, the electric power level of the pre-heating electric currents is switched after a point immediately before the fluorescent lamp is turned on and a point when the fluorescent lamp is turned on.

13. A method of operating a fluorescent lamp according to claim 9, wherein a second power source means comprises a transformer having a plurality of output coils respectively connected to a plurality of the filaments of the fluorescent lamp and one electric power receiving input coil, and the plurality of output coils of the transformer and the plurality of filaments of the fluorescent lamp are connected in such a manner that magnetic fluxes, which are generated in the output coils from a portion of the electric current supplied from a first power source means bypassing the plurality of output coils of the transformer and formed into a tube electric current in said supplying step of supplying a tube electric current, run in the same direction when the fluorescent lamp is turned on.

14. A method of operating a fluorescent lamp comprising the steps of:

supplying a tube electric current to a fluorescent lamp to turn on the fluorescent lamp;

supplying pre-heating electric currents to filaments of the fluorescent lamp using a second power source means; and monitoring an output from the second power source means to control the electric power level of the pre-heating electric currents to be supplied to the filaments by changing a ratio of supply/non-supply of the pre-heating electric currents to the filaments.

15. A method of operating a fluorescent lamp according to claim 14, wherein, in said step of supplying pre-heating electric currents, direct current is supplied to the filaments.

16. A method of operating a fluorescent lamp according to claim 14, wherein, in said monitoring step, the pre-heating electric currents to be supplied to the filaments are compensated in a transition period from a state in which the fluorescent lamp is turned off to a state in which the fluorescent lamp is turned on to a state in which the fluorescent lamp is turned off.

17. An apparatus for operating a fluorescent lamp comprising:

first power source means for supplying a tube electric current to the fluorescent lamp to turn on the fluorescent lamp;

second power source means for supplying pre-heating electric currents to filaments of the fluorescent lamp; and switching means for switching an electric power level of the pre-heating electric currents to be supplied to the filaments by said second power source means by changing an amplitude of the pre-heating electric currents to be supplied to the filaments.

18. An apparatus for operating a fluorescent lamp according to claim 17, wherein said second power source means supplies alternating current to the filaments.

19. An apparatus for operating a fluorescent lamp according to claim 17, wherein said switching means switches the electric power level of the pre-heating electric currents between a period in which the fluorescent lamp is turned off and a period in which the fluorescent lamp is turned on.

20. An apparatus for operating a fluorescent lamp according to claim 17, wherein said switching means switches the electric power level of the pre-heating electric currents after a point immediately before the fluorescent lamp is turned on and a point when the fluorescent lamp is turned on.

21. An apparatus for operating a fluorescent lamp according to claim 17, wherein said second power source means comprises a transformer having a plurality of output coils respectively connected to a plurality of the filaments of the fluorescent lamp and one electric power receiving input coil and the plurality of output coils of said transformer and the plurality of filaments of the fluorescent lamp being connected in such a manner that magnetic fluxes, which are generated in said output coils from a portion of the electric current supplied from said first power source means bypassing said plurality of output coils of said transformer and formed into a tube electric current, run in the same direction when the fluorescent lamp is turned on.

22. An apparatus for operating a fluorescent lamp comprising:

first power source means for supplying a tube electric current to the fluorescent lamp to turn on the fluorescent lamp;

second power source means for supplying pre-heating electric currents to filaments of the fluorescent lamp; and control means for monitoring an output from said second power source means to control the electric power level of said pre-heating electric currents to be supplied from said second power source means to the filaments by changing an amplitude of the pre-heating electric currents to be supplied to the filaments.

23. An apparatus for operating a fluorescent lamp according to claim 22, wherein said second power source means supplies direct current to the filaments.

24. An apparatus for operating a fluorescent lamp according to claim 22, wherein said control means compensates said pre-heating electric currents to be supplied from said second power source means to the filaments in a transition period from a state in which the fluorescent lamp is turned off to a state in which the fluorescent lamp is turned on or from a state in which the fluorescent lamp is turned on to a state in which the fluorescent lamp is turned off.

25. A method of operating a fluorescent lamp comprising the steps of:

supplying a tube electric current to a fluorescent lamp to turn on the fluorescent lamp;

supplying pre-heating electric currents to filaments of the fluorescent lamp; and switching an electric power level of the pre-heating electric currents to be supplied to the filaments by changing an amplitude of the pre-heating electric currents to be supplied to the filaments.

26. A method of operating a fluorescent lamp according to claim 25, wherein, in said step of supplying pre-heating electric currents, alternating current is supplied to the filaments.

27. A method of operating a fluorescent lamp according to claim 25, wherein, in said switching step, the electric power level of the pre-heating electric currents is switched between a period in which the fluorescent lamp is turned off and a period in which the fluorescent lamp is turned on.

28. A method of operating a fluorescent lamp according to claim 25, wherein, in said switching step, the electric power level of the pre-heating electric currents is switched after a point immediately before the fluorescent lamp is turned on and a point when the fluorescent lamp is turned on.

29. A method of operating a fluorescent lamp according to claim 25, wherein a second power source means comprises a transformer having a plurality of output coils respectively connected to a plurality of the filaments of the fluorescent lamp and one electric power receiving input coil, and the plurality of output coils of the transformer and the plurality of filaments of the fluorescent lamp are connected in such a manner that magnetic fluxes, which are generated in the output coils from a portion of the electric current supplied from a first power source means bypassing the plurality of output coils of the transformer and formed into a tube electric current in said supplying step of supplying a tube electric current, run in the same direction when the fluorescent lamp is turned on.

30. A method of operating a fluorescent lamp comprising the steps of:

supplying a tube electric current to a fluorescent lamp to turn on the fluorescent lamp;

supplying pre-heating electric currents to filaments of the fluorescent lamp using a second power source means; and monitoring an output from the second power source means to control the electric power level of the pre-heating electric currents to be supplied to the filaments by changing an amplitude of the pre-heating electric currents to be supplied to the filaments.

31. A method of operating a fluorescent lamp according to claim 30, wherein, in said step of supplying pre-heating electric currents, direct current is supplied to the filaments.

32. A method of operating a fluorescent lamp according to claim 30, wherein, in said monitoring step, the pre-heating electric currents to be supplied to the filaments are compensated in a transition period from a state in which the fluorescent lamp is turned off to a state in which the fluorescent lamp is turned on to a state in which the fluorescent lamp is turned off.

* * * * *